US008446799B2

(12) United States Patent
Burke, Jr. et al.

(10) Patent No.: US 8,446,799 B2
(45) Date of Patent: May 21, 2013

(54) CONTAINER CAP WITH A TIMER

(75) Inventors: Richard Million Burke, Jr., Westlake Village, CA (US); Aaron Horton, Xiamen (CN); Howard David Goldberg, Westlake Village, CA (US); Paul L. Stals, Palm Harbor, FL (US); Philip John Tomasi, Newbury Park, CA (US)

(73) Assignee: Timer Cap Company, LLC, Thousand Oaks, CA (US)

( * ) Notice: Subject to any disclaimer, the term of this patent is extended or adjusted under 35 U.S.C. 154(b) by 24 days.

(21) Appl. No.: 13/244,296

(22) Filed: Sep. 24, 2011

(65) Prior Publication Data

US 2012/0224458 A1 Sep. 6, 2012

Related U.S. Application Data

(63) Continuation-in-part of application No. 13/038,331, filed on Mar. 1, 2011.

(51) Int. Cl.
*G04B 47/00* (2006.01)

(52) U.S. Cl.
USPC ..... 368/10

(58) Field of Classification Search
USPC ..... 368/10, 107–112, 185, 187, 188, 368/278, 316–317; 221/2, 3, 15; 215/217–221, 215/228, 230
See application file for complete search history.

(56) References Cited

U.S. PATENT DOCUMENTS

| | | | |
|---|---|---|---|
| 2,961,108 | A | 11/1960 | Johnson |
| 4,261,656 | A | 4/1981 | Wu |
| 4,419,016 | A | 12/1983 | Zoltan |
| 4,826,914 | A | 5/1989 | Raedisch et al. |
| 5,030,686 | A | 7/1991 | Holzer et al. |
| 5,233,571 | A | 8/1993 | Wirtschafter |
| 5,268,136 | A | 12/1993 | Girard et al. |
| RE34,523 | E | 1/1994 | Daude et al. |
| 5,334,178 | A | 8/1994 | Haber et al. |
| 5,751,661 | A | 5/1998 | Walters |
| 5,798,409 | A | 8/1998 | Ho |
| 6,324,123 | B1 | 11/2001 | Durso |
| 6,424,599 | B1 | 7/2002 | Ditzig |
| 6,667,936 | B1 | 12/2003 | Ditzig |
| 6,707,763 | B2 | 3/2004 | Osberg et al. |

(Continued)

FOREIGN PATENT DOCUMENTS

| | | |
|---|---|---|
| CN | 1498829 | 5/2004 |
| WO | 2007011656 | 1/2007 |
| WO | 2007011656 | 6/2007 |

OTHER PUBLICATIONS

The International Searching Authority, International Search Report, Sep. 28, 2012, 11 pages, Korea.

*Primary Examiner* — Edwin A. Leon
(74) *Attorney, Agent, or Firm* — Marc E. Hankin; Kevin Schraven; Hankin Patent Law, APC

(57) ABSTRACT

The invention is a container cap with a timer. The timer has a centralized activation pin or mechanism that activates the timer when the cap is secured to a container. The timer is used to determine how much time has passed since the cap was secured to the container. The timer cap of the present invention is streamlined, easier to use, more reliable, and has a lower manufacturing cost than currently available timer caps.

30 Claims, 17 Drawing Sheets

U.S. PATENT DOCUMENTS

| | | | | |
|---|---|---|---|---|
| 6,845,064 | B2 | 1/2005 | Hildebrandt | |
| 7,081,807 | B2 | 7/2006 | Lai | |
| 7,362,660 | B2 | 4/2008 | Hildebrandt | |
| 7,408,843 | B2 | 8/2008 | Brandon | |
| 7,719,927 | B1 * | 5/2010 | Robinson et al. | 368/10 |
| 7,796,472 | B2 | 9/2010 | Brandon | |
| 7,907,477 | B2 * | 3/2011 | Puzia | 368/10 |
| 8,045,420 | B2 * | 10/2011 | Newman | 368/10 |
| 2003/0198134 | A1 | 10/2003 | Hildebrandt | |
| 2005/0121407 | A1 | 6/2005 | Hildebrandt | |
| 2005/0151625 | A1 | 7/2005 | Lai | |
| 2007/0014191 | A1 | 1/2007 | Brandon | |
| 2009/0078670 | A1 | 3/2009 | Brandon | |
| 2010/0142330 | A1 * | 6/2010 | Reygaert | 368/10 |
| 2011/0069587 | A1 | 3/2011 | Brandon | |
| 2011/0216627 | A1 * | 9/2011 | Ziemba et al. | 368/10 |
| 2012/0257478 | A1 * | 10/2012 | Marcellino | 368/10 |

* cited by examiner

CONTAINER CAP WITH A TIMER

CROSS-REFERENCE TO RELATED APPLICATIONS

This application is a Continuation-in-Part of U.S. Non-Provisional patent application Ser. No. 13/038,331, filed on Mar. 1, 2011, titled "CONTAINER CAP WITH PROTECTIVE COVER" by inventor Richard Million Burke, Jr., the contents of which are expressly incorporated herein by this reference, and to which priority is claimed.

FIELD OF THE INVENTION

The present invention generally relates to container caps, and, more particularly, to enclosure caps with integrated timers to determine when the medication was last taken for vials, bottles, containers, and the like for pharmaceutical, drug, over-the-counter medications, nutraceutical, pet medications, or similar "smart" packaging applications. The timer has a centralized activation switch.

BACKGROUND OF THE INVENTION

A container cap is typically used to selectively and removeably cover the open upper end of a container, such as used for pills or medication. One problem that arises with medication, both prescription and nonprescription, is that patients sometimes do not remember to take the medication at the designated times (e.g., every four hours). Alternately, sometimes patients do not remember when the last time that medication was taken. In an attempt to address these problems, various timing systems and timers have been developed.

Modern pharmaceutical practice relies on patients to consistently take their medication at one or more specific intervals during the day. Typically, the patient's doctor will create a medication schedule for the patient and instruct the patient to follow the schedule. However, this can become an issue: (1) since in our multi-tasking and multi-media based living and working environments, which competes for our attention spans, can impact the patient's ability to reliably remember when the last time they took their medication; (2) the patient's memory capacity can be impacted if they are elderly and/or dealing with the pain and stresses of illness; or (3) when the patient has multiple medications that may be taken at different times, the schedule can quickly become complex and unwieldy.

In an effort to simplify medication schedules and keep better track of when a particular medication was last taken, various products and methods have been developed. U.S. Pat. No. ("USPN") 6,707,763, issued to Osberg, and hereby incorporated by reference as though set forth below in its entirety, discloses a pharmaceutical bottle timer cap that informs the user how long it has been since the medication in the bottle was taken. The Osberg timer cap automatically starts the timer when the cap is replaced on the bottle after the medication has been taken. But, the Osberg timer cap discloses and claims an activation switch that is biased on an outer edge. In this manner the timer is activated by the side pin being displaced directly by the lip of the bottle opening. Unfortunately, the side activation switch of Osberg requires the use of a relatively complex mechanism to translate the mechanical pin displacement to a resetting of the integrated electronic timer. As such, the Osberg side-pin activation switch requires a significant number of components that limits the reduction of the manufacturing costs of the timer cap and the improvements in the reliability of the switch properly working over repeated cycles of use. Also, the Osberg side-pin activation switch requires a different timer module design for each timer cap design that needs to be manufactured for each of the various sizes of pharmaceutical bottles and vials, this adds significant timer cap manufacturing and inventory costs. Cost and repeated-use reliability are key drivers for the high-volume consumer target markets of retail pharmacy, drug manufacturers, and managed health-care providers. Also, a timer cap with a side-pin activation switch has an inherent disadvantage compared to a timer cap with a center-pin activation switch as it does not leverage the benefits of mechanical symmetry, which help improve performance sensitivity and reliability. A timer cap with center-pin activation would enable a standard timer module design to be used for all sizes and styles of timer caps, which significantly reduces timer cap manufacturing an inventory costs.

Another example of a cap with a timer is U.S. Pat. No. 5,751,661, issued to Walters describes a closure cap having an integrated timer. The timer is activated and deactivated by a moveable disk that engages and disengages a battery beneath the timer. The timer cap, and more specifically, the moveable disk, described in the Walters patent, however, may be somewhat awkward and unreliable. The disk may stick in position if it is not properly aligned. Accordingly, the timer cap described in the Walters patent may be difficult to manipulate and may not provide an accurate indication of time. Also, the complexity of the design and the number of components required, make the manufacturing cost prohibitively high for the high-volume consumer markets.

Similarly, U.S. Pat. No. 6,324,123, issued to Durso, describes a programmable medication timer on a closure cap that indicates the appropriate time for the user to take medication. The timer described in the Durso patent, however, is very complicated and requires specific programming to remind the user to take medication.

U.S. Pat. No. 7,408,843, issued to Brandon, discloses a cap with a timer wherein the timer includes an interior activation post. However, the Brandon interior activation post is attached to a flexible diaphragm, wherein the diaphragm is separate from the sealing disk. Accordingly, the Brandon cap is very complicated, unreliable, and would be very expensive to manufacture.

Thus, there remains a long felt need in the art for an intelligent and easy-to-use timer cap that has a streamlined and cost-effective design that is achieved through the use of a centralized activation switch.

SUMMARY OF THE INVENTION

To minimize the limitations in the prior art, and to minimize other limitations that will become apparent upon reading and understanding the present specification, the present invention is a container cap with a timer. The timer has a centralized activation mechanism that activates the timer when the cap is secured to a container. The timer is used to determine how much time has passed since the cap was secured to the container. The timer cap of the present invention is streamlined, easier to use, more reliable, and lower manufacturing cost than currently available timer caps.

One embodiment of the invention is a container cap with a timer, comprising: a container cap, wherein the container cap comprises: a timer, a sealing disk, a center post, and a first housing portion. The sealing disk is substantially circular and is comprised of an upper surface and a lower surface. The center post is attached to the upper surface of the sealing disk and extends substantially perpendicularly away from the upper surface. The timer is comprised of a display and an activation switch. The first housing portion is comprised of a timer slot and an outer cylindrical wall portion. The outer cylindrical wall portion has and an outer surface and an inner surface. The inner surface of the outer cylindrical wall portion has one or more container engagement portions. The timer slot of the first housing portion has a lower surface and one or more timer side walls, wherein the lower surface of the timer slot has a substantially central hole. The timer is positioned within the timer slot such that the display is visible on a top side of the first housing portion, and the activation switch is accessible through the substantially central hole of the lower surface of the timer slot. The sealing disk is positioned within the inner surface of the outer cylindrical wall portion between the lower surface of the timer slot and the one or more container engagement portions, such that the center post is positioned to be able to pass through the substantially central hole of the lower surface of the timer slot, and the sealing disk is kept substantially in place within the inner surface of the outer cylindrical wall portion. Preferably, the sealing disk and the center post are pushed towards the timer when the container cap is engaged with or secured onto a container, such that the center post activates the activation switch of the timer and starts the timer; and wherein the center post ceases to activate the activation switch of the timer when the container cap is disengaged with the container. Preferably, the container cap further comprises a center post spring. Wherein the center post spring is connected to the center post such that a lower portion of the center post spring matingly surrounds the center post and an upper portion of the center post spring extends beyond the center post. The center post spring preferably ensures that the center post ceases to activate the activation switch of the timer when the container cap is disengaged from the container. Preferably the container cap is a childproof container cap and the timer is used to determine when the container cap was secured to the container. Alternatively, the one or more container engagement portions may be an internal screw thread, which is preferably configured to matingly engage and disengage with an external screw thread of a childproof container. The first housing portion may further comprise one or more sealing disk engagement ridges, wherein the one or more sealing disk engagement ridges are configured to keep the sealing disk substantially in place within the inner surface of the outer cylindrical wall portion.

In another embodiment of the invention the first housing portion is further comprised of a substantially flat top surface, wherein the top surface extends between the one or more timer side walls of the timer slot and the outer cylindrical wall portion, and wherein the substantially flat top surface of the first housing portion is substantially flush with a substantially flat top surface of the timer. The timer is preferably further comprised of a plurality of locking tabs; and the timer slot of the first housing portion is further comprised of a plurality of notches. When the timer is positioned within the timer slot, the plurality of locking tabs matingly engage with the plurality of notches such that the timer is held in place within the timer slot. The container cap is further comprised of a protective cover. The protective cover substantially covers a top surface of the timer, the display of the timer, and the substantially flat top surface of the first housing portion; and wherein the protective cover is preferably transparent over the display of the timer, such that the display is visible through the protective cover. Preferably the container cap is a childproof container cap and the timer is used to determine when the container cap was secured to the container.

In another embodiment of the invention the container cap is preferably further comprised of a second housing portion, wherein the second housing portion is comprised of a substantially flat top surface, a display hole, and an outer cylindrical wall portion. The second housing portion preferably matingly engages with the first housing portion such that the timer is covered by the substantially flat top surface of the second housing portion, wherein the display of the timer is substantially visible through the display hole of the second housing portion, and wherein an outer surface of the outer cylindrical wall portion of the second housing portion is within the inner surface of the outer cylindrical wall portion of the first housing portion. The timer is preferably further comprised of a plurality of locking tabs. The timer slot of the first housing portion is preferably further comprised of a plurality of notches, wherein when the timer is positioned within the timer slot, the plurality of locking tabs of the timer matingly engage with the plurality of notches of the timer slot such that the timer is held in place within the timer slot. Additionally, the second housing portion may also have a plurality of locking tabs and the first housing portion is further comprised of a plurality of notches. Wherein when the second housing portion matingly engages with the first housing portion, the plurality of locking tabs of the second housing portion matingly engage with the plurality of notches of the first housing portion such that the second housing portion is held in place within the first housing portion. Preferably the container cap is a childproof container cap and the timer is used to determine when the container cap was secured to the container.

In another embodiment of the center post may have a microswitch activation tip, and the activation switch may be comprised of two microswitch pads. The microswitch activation tip creates an electrically conductive bridge that activates the timer when the container cap is secured to the container. Preferably, the container cap includes a protective cover; wherein the protective cover substantially covers a top surface of the second housing portion and the display hole of the second housing portion; and wherein the protective cover is transparent over the display hole of the second housing portion, such that the display is visible through the protective cover. Preferably the container cap is a childproof container cap and the timer is used to determine when the container cap was secured to the container.

Another embodiment of the invention is a container cap; wherein the container cap comprises: a timer, an activation mechanism, and a housing portion. The housing portion is comprised of face piece with a timer slot, a lower cylindrical container engagement portion, a shoulder portion, and an upper cylindrical wall portion. The shoulder portion is disposed between the lower cylindrical container engagement portion and the upper cylindrical wall portion, and wherein the shoulder portion is comprised of one or more container engagement pin holes. The timer is comprised of a display and an activation switch. The timer is positioned within the timer slot such that the display is visible on a top side of the housing portion, and the activation switch is accessible on a bottom side of the timer. The activation mechanism is substantially rigid and comprised of an activation switch engagement portion, one or more activation arms, and one or more container engagement pins. The activation arms connect the activation switch engagement portion to the one or more container engagement pins. The activation mechanism is positioned within the housing portion such the one or more container engagement pins of the activation mechanism are disposed slideably within the one or more container engagement pin holes of the shoulder portion, and wherein the activation switch engagement portion of the activation mechanism is adjacent to the activation switch of the timer, such that when the container cap is engaged with a container, a lip of the container engages with the one or more container engagement pins of the activation mechanism, which causes the activation switch engagement portion of the activation mechanism to engage with the activation switch of the timer and starts the timer. Preferably, the container cap with a timer also includes a removable cylindrical childproof safety ring. The removable cylindrical childproof safety ring has an interior surface and an exterior surface. The interior surface of the removable cylindrical childproof safety ring has an upper portion and a lower portion and wherein the lower portion of the interior surface has one or more childproof engagement portions. The upper portion of the interior surface of the removable cylindrical childproof safety ring removeably and matingly engages with an exterior surface of the upper cylindrical wall portion. The childproof engagement portions of the removable cylindrical childproof safety ring engages with an exterior surface of the container when the container cap is secured to the container. The removable child-proof safety ring allows the closure cap to be used with any type of container that uses a child-proof or child-resistant opening. The removable child-proof safety ring. The housing can be readily inserted into the removable child-proof safety ring so that the closure cap can be secured to a child-proof pill container as well as to a pill container having a threaded opening.

Another embodiment of the invention is a container cap, wherein the container cap comprises: a timer, a sealing disk, a center post, and a housing portion. The sealing disk is substantially circular and is comprised of an upper surface and a lower surface. The center post is attached to the upper surface of the sealing disk and extends substantially perpendicularly away from the upper surface. The timer is comprised of a display and an activation switch. The housing portion is comprised of a timer slot and an outer cylindrical wall portion. The outer cylindrical wall portion has and an outer surface and an inner surface. The inner surface of the outer cylindrical wall portion has threads to engage with common screw-on threading of bottles or containers. The timer slot of the housing portion has a lower surface and one or more timer side walls, wherein the lower surface of the timer slot has a substantially central hole. The timer is positioned within the timer slot such that the display is visible on a top side of the housing portion, and the activation switch is accessible through the substantially central hole of the lower surface of the timer slot. The sealing disk is positioned within the inner surface of the outer cylindrical wall portion between the lower surface of the timer slot and the one or more sealing disk engagement ridge structures, such that the center post is positioned to be able to pass through the substantially central hole of the lower surface of the timer slot, and the sealing disk is kept substantially in place within the inner surface of the outer cylindrical wall portion. Preferably, the sealing disk and the center post are pushed towards the timer when the container cap is engaged with or secured onto a container, such that the center post activates the activation switch of the timer and starts the timer; and wherein the center post ceases to activate the activation switch of the timer when the container cap is disengaged with the container. Preferably, the container cap further comprises a center post spring. Wherein the center post spring is connected to the center post such that a lower portion of the center post spring matingly surrounds the center post and an upper portion of the center post spring extends beyond the center post. The center post spring preferably ensures that the center post ceases to activate the activation switch of the timer when the container cap is disengaged from the container. Preferably the container cap is a childproof container cap and the timer is used to determine when the container cap was secured to the container.

Another embodiment of the invention is a container cap with a timer, comprising: a container cap. Wherein the container cap comprises: a timer, a sealing disk, and an activation mechanism. The sealing disk is substantially circular and is comprised of an upper surface and a lower surface. The activation mechanism is attached to the upper surface of the sealing disk and extends substantially perpendicularly away from the upper surface of the sealing disk. The timer is comprised of a display and an activation switch. The timer is positioned within the container cap such that the display is visible on a top side of the container cap. The activation switch is on a bottom side of the timer. The sealing disk is positioned within the container cap such that the activation mechanism engages with the activation switch when the container cap is engaged with a container and starts the timer. Preferably, the activation mechanism ceases to automatically activate the activation switch of the timer when the container cap is disengaged with the container. Preferably, the sealing disk is cup-shaped. Preferably, the activation mechanism is a center post. Preferably, the one or more container engagement portions is an internal screw or lug thread, and the internal screw or lug thread is configured to matingly engage and disengage with an external screw or bayonet thread of the container. Preferably, the internal screw or lug thread substantially keeps the sealing disk in place within the container cap. Preferably, the container cap further comprises: a center post spring; wherein the center post spring is connected to the center post such that a lower portion of the center post spring matingly surrounds the center post and an upper portion of the center post spring extends beyond the center post. The center post spring ensures that the center post automatically ceases to activate the activation switch of the timer when the container cap is disengaged with the container.

The activation switch engagement portion may have a microswitch activation tip, wherein the activation switch is comprised of two microswitch pads. Preferably, the micro switch activation tip creates an electrically conductive bridge that activates the timer when the container cap is secured to the container. The container cap further comprises a protective cover, wherein the protective cover and substantially covers a top surface of the top housing cover; and wherein the protective cover is transparent over the display of timer, such that the timer display is visible through the protective cover.

It is an object of the invention to provide container cap with a timer that is reliable, inexpensive, easy to use, and informs the user how long it has been since the cap was last secured to a container.

Another object of the invention is to provide a container cap with a timer that may be used with numerous types of containers, including threaded containers, childproof and non-childproof pharmaceutical bottles and vials, childproof and non-childproof over-the-counter medication bottles and vials and plain friction top containers.

Other features and advantages are inherent in the container cap with a timer as claimed and disclosed will become apparent to those skilled in the art from the following detailed description and its accompanying drawings.

DETAILED DESCRIPTION OF THE DRAWINGS

In the following detailed description of the preferred embodiment, reference is made to the accompanying drawings that form a part hereof, and in which is shown, by way of illustration, a specific embodiment in which the invention may be practiced. It is to be understood that other embodiments may be utilized and structural changes may be made without departing from the scope of the present invention.

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

The term "container cap" refers to a lid, cap, top, topper, bung, stopper, cover, tap, seal, or closure of a container or bottle. The cap and container are preferably a pharmaceutical prescription safety cap and a pharmaceutical prescription bottle or vial, but they may be any cap or container without deviating from the scope of the invention, including those used for the packaging of over-the-counter medications, nutraceuticals, and pet medications.

The container cap is typically made of plastic or some other synthetic material, but any natural or man-made material may be used.

The timer incorporated into the container cap of the present invention is preferably a digital timer with a display that is automatically activated and deactivated when the cap is affixed to, or removed from, the container, however, the timer may be analog without deviating from the scope of the invention.

Although the drawings show the portions of the container cap being distinct or integrated, it should be understood the container cap may be made out of fewer or more parts without deviating from the scope of the invention.

The parts, portions, and/or pieces of the container cap of the present invention may be assembled through any device or means, including, but not limited to a snap-fit assembly, glue, epoxy, ultrasonic welding, clips, fasteners, and/or friction, without deviating from the scope of the invention.

Figure 1:
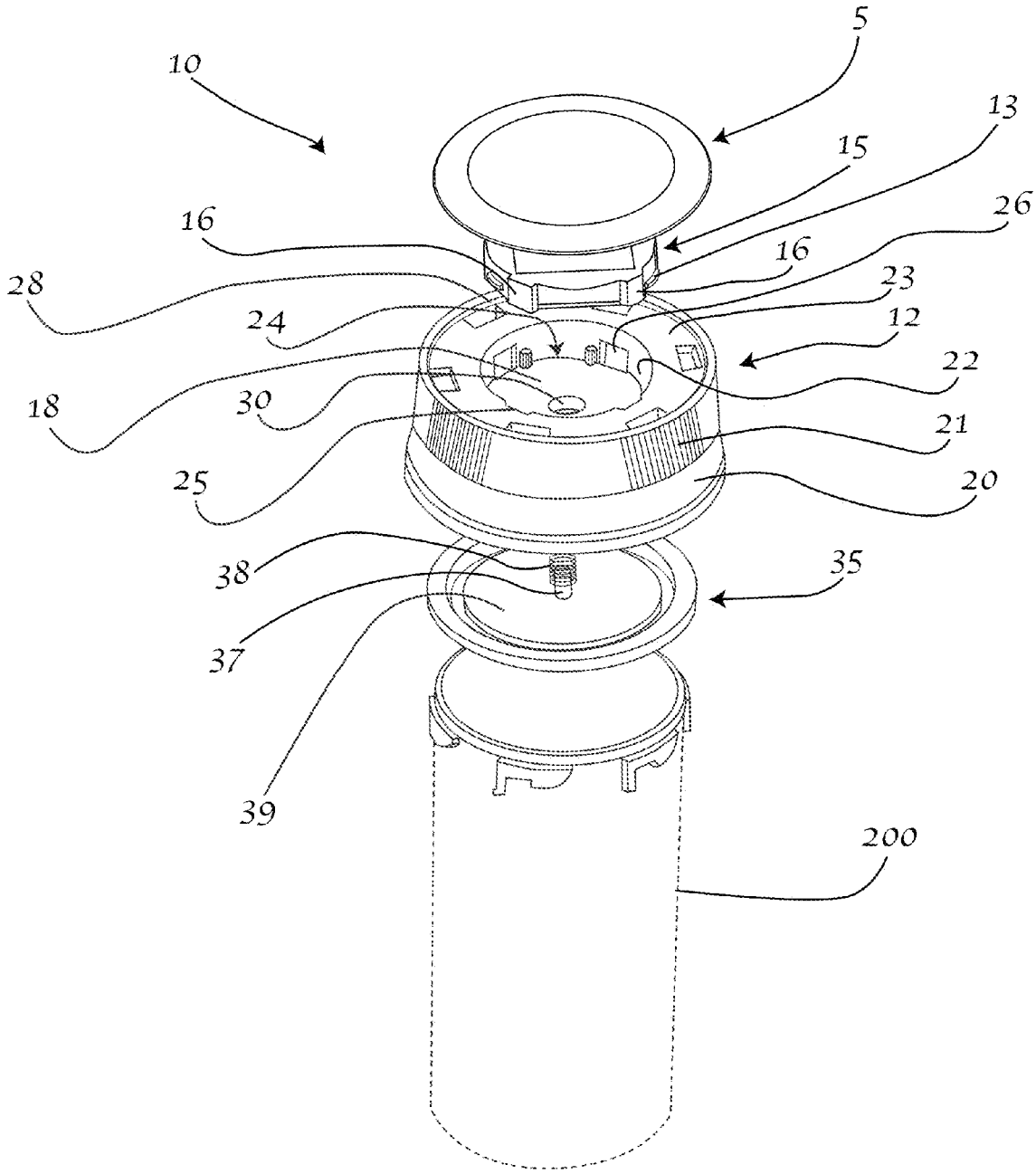
FIG. 1 is an illustration of a top exploded view of one embodiment of a container cap with a timer showing a topless housing.

FIG. 1 is an illustration of a top exploded view of one embodiment of a container cap with a timer showing a topless housing. As shown in FIG. 1, the container cap 10 is preferably comprised of a protective cover 5, timer 15, a sealing disk 35, a center post 37, center post spring 38, and a first housing portion 12. The timer 15 preferably includes a display 17, which is typically a liquid crystal display, activation switch 105 (shown in FIGS. 2 and 5), and an upper surface 19. The timer 15, also referred to as a timer module, may also include a housing, typically made out of plastic, an integrated circuit board, battery, and microswitch. The timer also preferably includes timer alignment features 16, which improve the manufacturing efficiency of the assembly process and thus helps reduce manufacturing costs. The timer may also include a snap fit leg 13 that fits with notch 26 to securely, but removeably hold timer 15 within first housing portion 12. As shown in FIG. 1, the first housing portion 12 preferably includes an outer cylindrical wall portion 20, grip ridges 21, which allows the device to be gripped and turned more easily, timer slot 24, slot alignment features 25, and top surface 23. Preferably, the timer slot 24 has a lower surface 18 and timer side wall 22. FIG. 1 shows how the lower surface 18 of the timer slot 24 preferably has a substantially central hole 30. Timer alignment portions 16 and slot alignment portions 25, as shown in FIG. 1, preferably align to increase the efficiency of the assembly process.

As shown in FIG. 1, sealing disk 35 is preferably substantially circular and is preferably comprised of an upper surface 39 and a lower surface 41 (shown in FIG. 2). FIG. 1 also shows that the center post 37 is may be part of or attached to attached to the upper surface 39 of the sealing disk 35 and extends substantially perpendicularly away from the upper surface 39. FIG. 1 also shows how timer 15 is preferably adapted to fit into timer slot 24 and that sealing disk 35 is adapted to fit within first housing portion 12 such that center post 37 lines up with central hole 30.

FIG. 1 also shows how first housing portion 12 preferably has a lip or recess 28 into which the protective cover 5 fits.

FIG. 1 also shows that the container cap 10 preferably engages with a container 200.

Figure 2A:
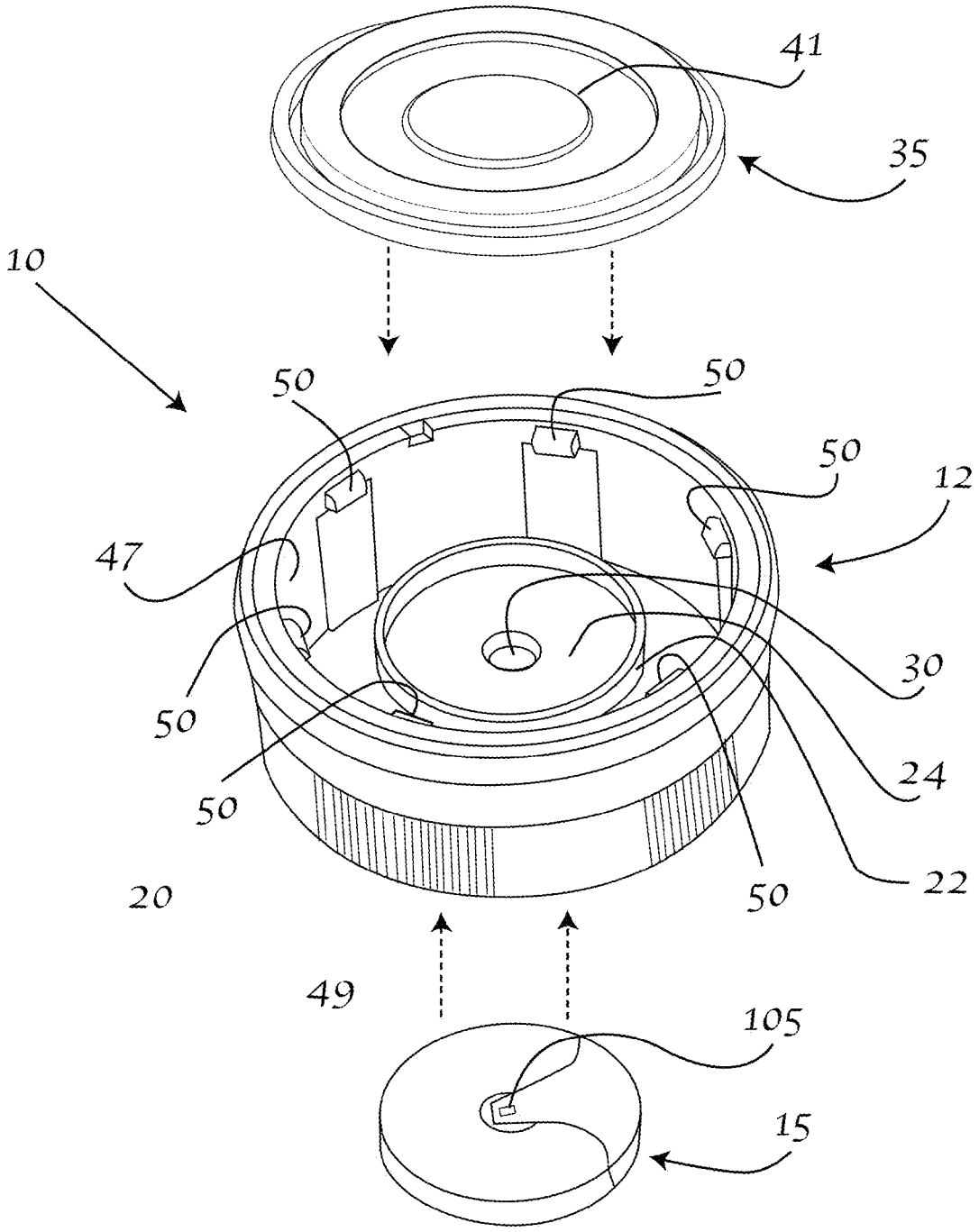
FIG. 2*a* is an illustration of a bottom exploded view of one embodiment of a container cap with a timer.

FIG. 2*a* is an illustration of a bottom exploded view of one embodiment of a container cap with a timer. As shown in FIG. 2, the timer slot 24 of first housing portion 12 preferably has timer side wall 22 and a substantially central hole 30. FIG. 2*a* also shows the lower surface 41 of sealing disk 35. Sealing disk 35 is preferably adapted to create a seal between the container cap 10 and a container, when the container cap 10 is secured to, or otherwise engaged with, the container. FIG. 2*a* shows that the outer cylindrical wall portion 20 has and an outer surface 49 and an inner surface 47. Preferably, the inner surface 47 of the outer cylindrical wall portion 20 has one or more container engagement portions 50. FIG. 2*a* also shows that the timer has an activation switch 105 that is aligned with central hole 30, such that when timer 15 is inserted into timer slot 15, the activation switch 105 is accessible through central hole 30. In the embodiment shown in FIG. 2, the container engagement portions may also be used to retain the sealing disk 35.

Figure 2B:
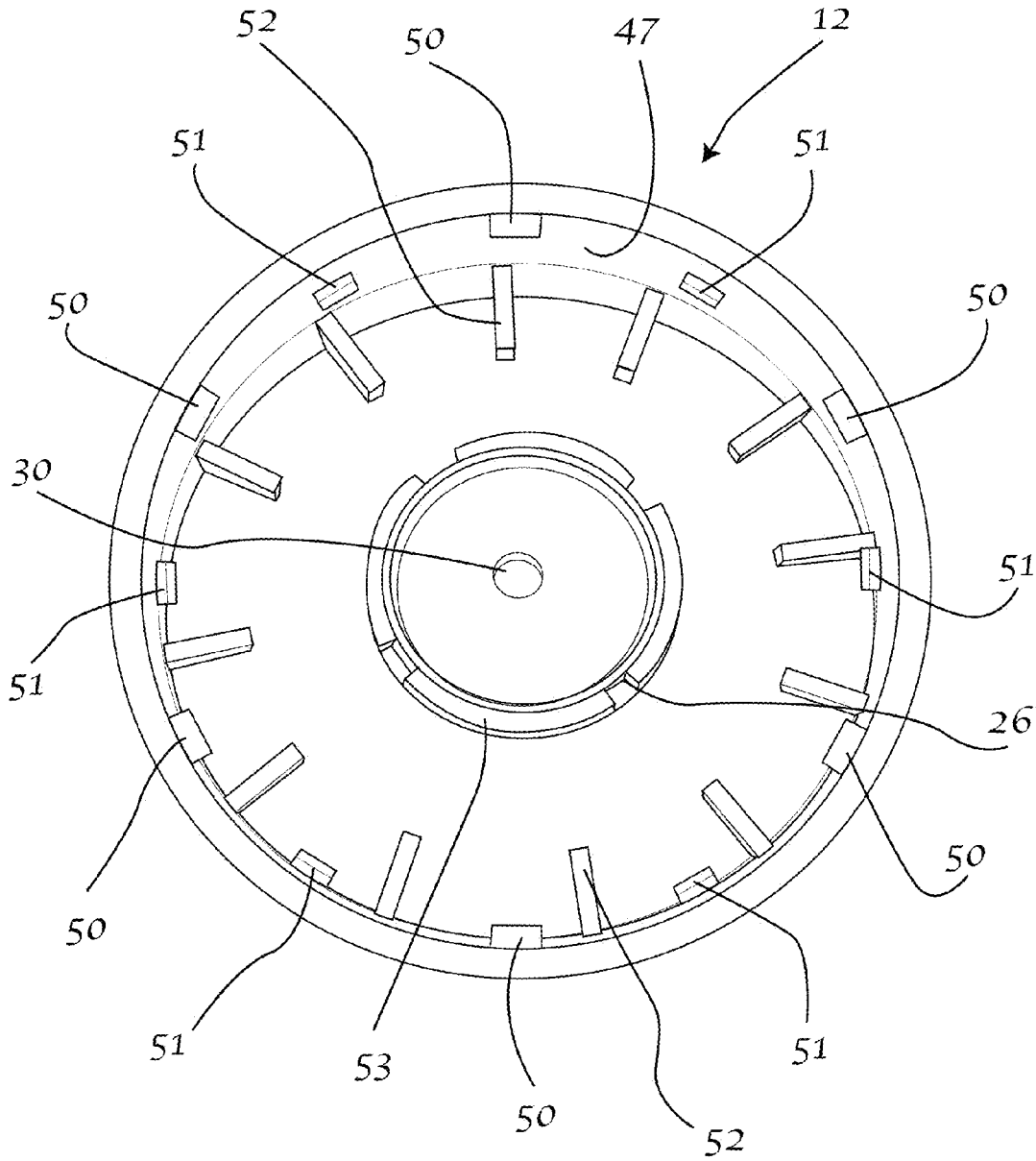
FIG. 2*b* is an illustration of a bottom perspective view of another embodiment of a container cap with a timer.

FIG. 2*b* is an illustration of a bottom perspective view of another embodiment of a container cap with a timer. As shown in FIG. 2*b*, the first housing portion 12 may include container engagement portions 50 and sealing disk engagement portions 51, which are preferably on a single plane or tier. FIG. 2*b* also shows that the first housing portion 12 may also include rib structures 52, which ensure that the sealing disk 35 remains captured by the engagement portions 50, or sealing disk engagement portions 51. The rib structures 52 and the sealing disk engagement portions 51 preferably keep sealing disk 35 in place so that it does not move to an angle which allows it to slip free from first housing portion 12. The use of rib structures 52 preferably minimizes the usage of raw container cap material which helps maintain low manufacturing costs. FIG. 2*b* shows how with container caps 10 that have a deep inner surface 47, the tier of sealing disk engagement portions 51 ensure that the sealing disk 35 remains captured for all ranges and angles of sealing disk 35. The container engagement portions 50 enable the container cap 10 to be engaged with the container.

Figure 3:
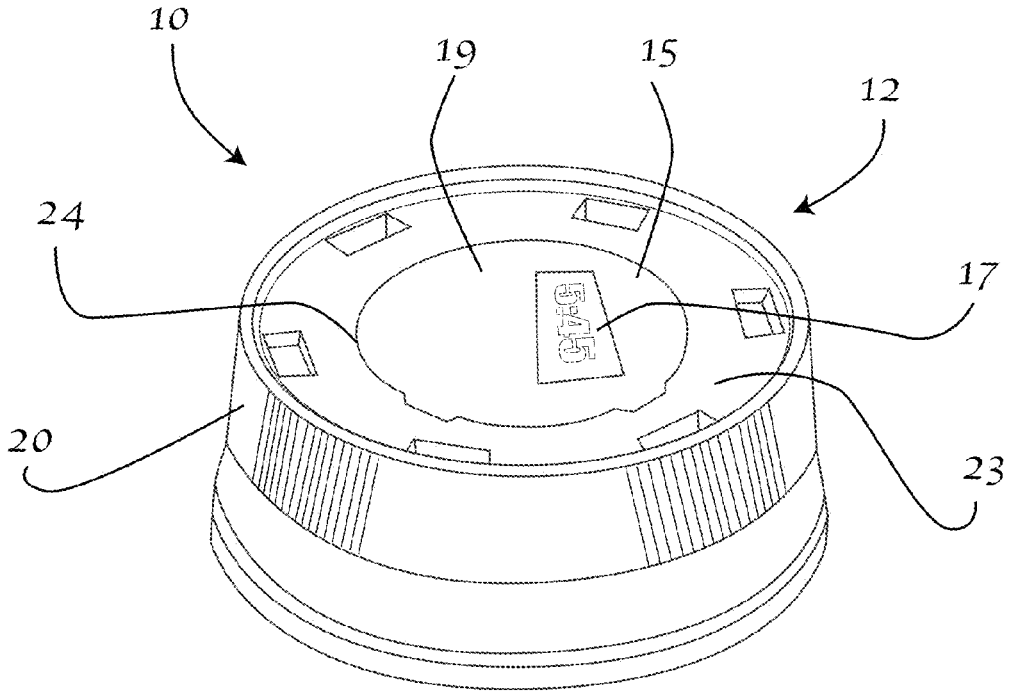
FIG. 3 is an illustration of a top perspective view of one embodiment of container cap with a timer.

FIG. 3 is an illustration of a top perspective view of one embodiment of container cap with a timer. As shown in FIG. 3, the timer 15 is positioned within timer slot 24 and has a substantially flat top surface 23, wherein the top surface 23 extends between timer side walls 22 of said timer slot 24 and the outer cylindrical wall portion 20. FIG. 3 also shows that the flat top surface 23 of the first housing portion 12 is substantially flush with a substantially flat top surface 19 of the timer 15. This allows the container cap to easily accept a protective cover or graphics on a top of the container cap 12. FIG. 3 also shows how display 17 is visible on a top of timer 15.

Figure 4:
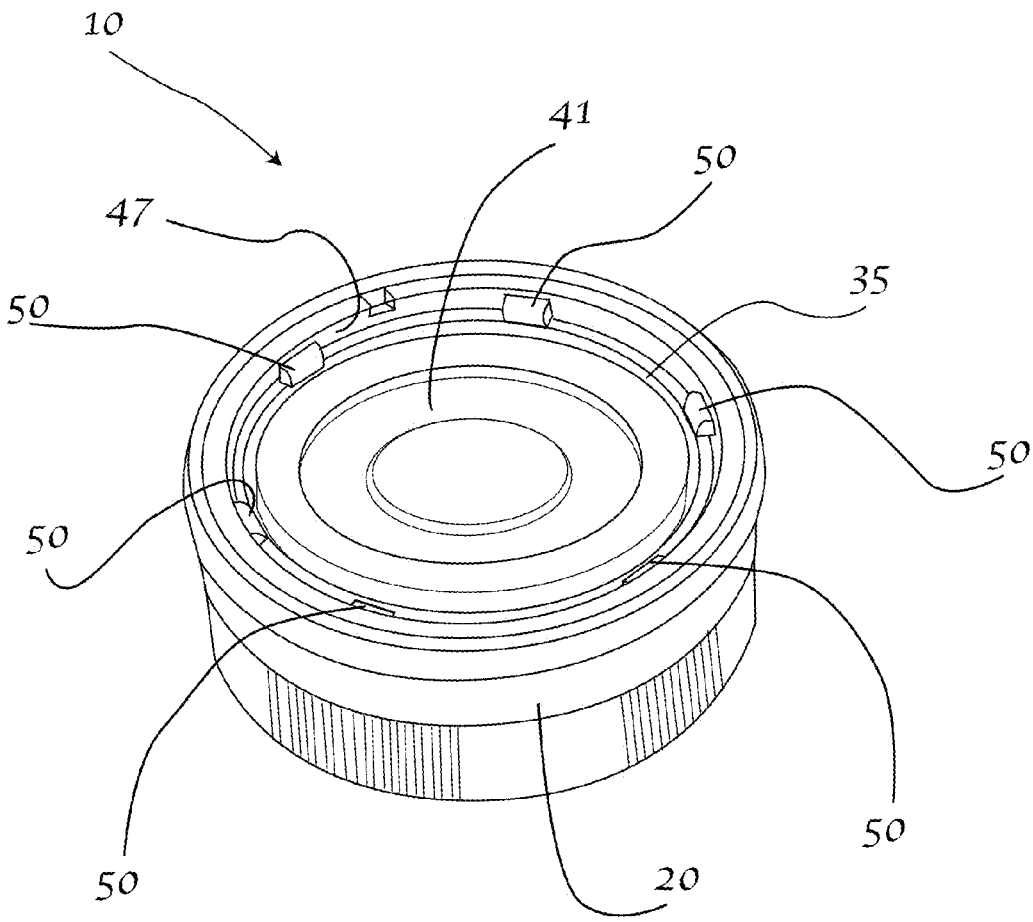
FIG. 4 is an illustration of a bottom perspective view of one embodiment of a container cap with a timer.

FIG. 4 is an illustration of a bottom perspective view of one embodiment of a container cap with a timer. FIG. 4 shows how the sealing disk 35 has a lower surface 41 and is positioned within the inner surface 47 of the outer cylindrical wall portion 20 between the lower surface of the timer slot 24 and the one or more container engagement portions 50. The sealing disk 35 is kept substantially in place within the inner surface 47 of the outer cylindrical wall portion 20 by the container engagement portions 50.

Figure 5:
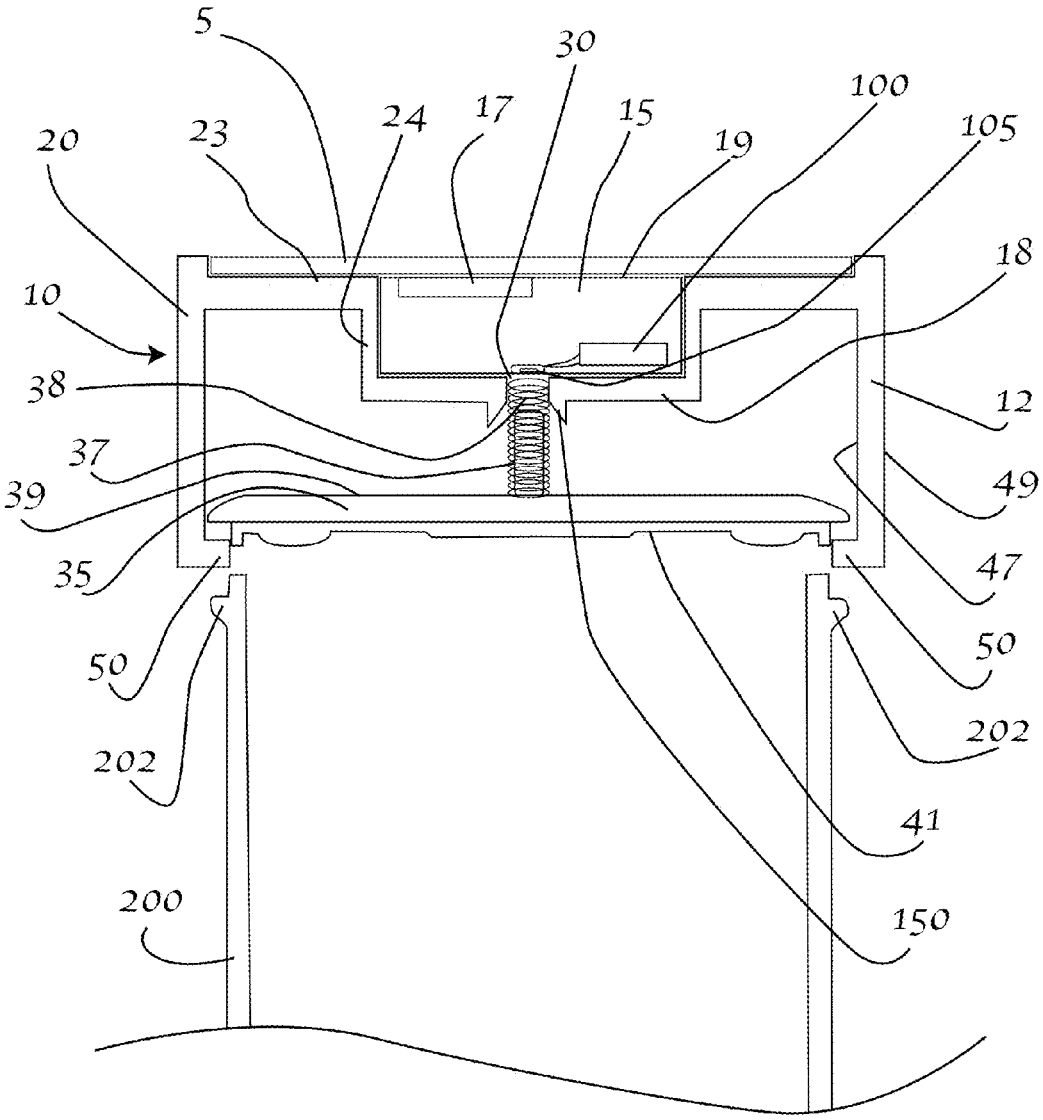
FIG. 5 is an illustration of a cross-section view of one embodiment of a container cap with a timer showing a topless housing.

FIG. 5 is an illustration of a cross section view of one embodiment of a container cap with a timer showing a topless housing. As shown in FIG. 5, container cap 10 engages with container 200, and is preferably comprised of first housing portion 12, timer 15, central post 37, central post spring 38, and sealing disk 35. First housing portion 12 is preferably comprised of outer cylindrical wall 20, top surface 23, inner surface 47, outer surface 49, timer slot 24, timer lower surface 18, central hole 30, and container engagement portion 50. The timer preferably includes display 17, battery 100, timing electronics, activation switch 105, and top surface 19. The sealing disk 35 is preferably comprised of upper surface 39 and lower surface 41. As shown in FIG. 5, the center post 37 is positioned to be able to pass through the substantially central hole 30 of the lower surface 18 of the timer slot 24. FIG. 5 shows that the sealing disk 35 and said center post 37 are pushed towards the timer 15 when the container cap 12 is engaged with, or secured to, a container 200. In this manner, the center post 37 activates the activation switch 105 of the timer 15 and starts the timer 15. Preferably, the center post 37 ceases to activate the activation switch 105 of the timer 15 when the container cap 10 is disengaged with the container 200. FIG. 5 also shows said center post spring 38 is connected to the center post 37 such that a lower portion of said center post spring 38 matingly surrounds the center post 37 and an upper portion of said center post spring 38 extends beyond the distal length of the center post 37. The center post spring 38 helps to push the sealing disk 35 away from the timer 15 and ensures that said center post 37 ceases to activate the activation switch 105 of the timer 15 when the container cap 12 is disengaged with the container 200. The container cap 10, as shown in FIG. 5 is further comprised of a protective cover 5. The protective cover 5 substantially covers a top surface 19 of the timer 15, the display 17 of the timer 15, and the substantially flat top surface of the first housing portion 12. The protective cover 5 is preferably transparent over at least the display 17 of the timer 15, such that the display 17 is visible through the protective cover 5. As shown in FIG. 5, the container 200 is preferably a childproof pill bottle that has a plurality of container cap engagement portions 202. Although the container 200 and container cap 10 are shown as matingly engaged through a child-proof locking mechanism, any engagement mechanism may be used, including compatible screw-on threading.

The protective cover 5 shown in the drawings is preferably made from scratch resistant or self-healing polymer or gel and helps protect the timer 15 and any graphics on the container cap 10, or within the protective cover 5. The self-healing polymer may include, but is not limited to: epoxy resins, polymer gels, polyurethanes, latex, silicone, and butyl rubber, and/or polycarbonate sheets, which might include a hard-coat outer layer that uses a cold-flow mechanism to heal scratches to the hard-coat. The self-healing polymer usually has one or more layers.

Preferably, the timer 15 shows on display 17 the duration of time, in hours and minutes, since the timer 15 was activated. In this manner, the user knows when he or she last took the medication within the container 200. When the activation switch 105 is disengaged, the timer 15 stops, and the display 17, which is preferably digital, stops counting and ceases to display any numbers. The timer 15 is reset and re-started after the container cap 10 is re-engaged with container 200. Accordingly, it is very important that the activation switch 105 stay engaged until the container cap 10 is removed by the user, so that the user is not given a false duration of time since he or she last took the medicine. The present invention is streamlined and designed specifically for reliability, despite repeated engagement and disengagement of container cap 10 to container 200.

Figure 6:
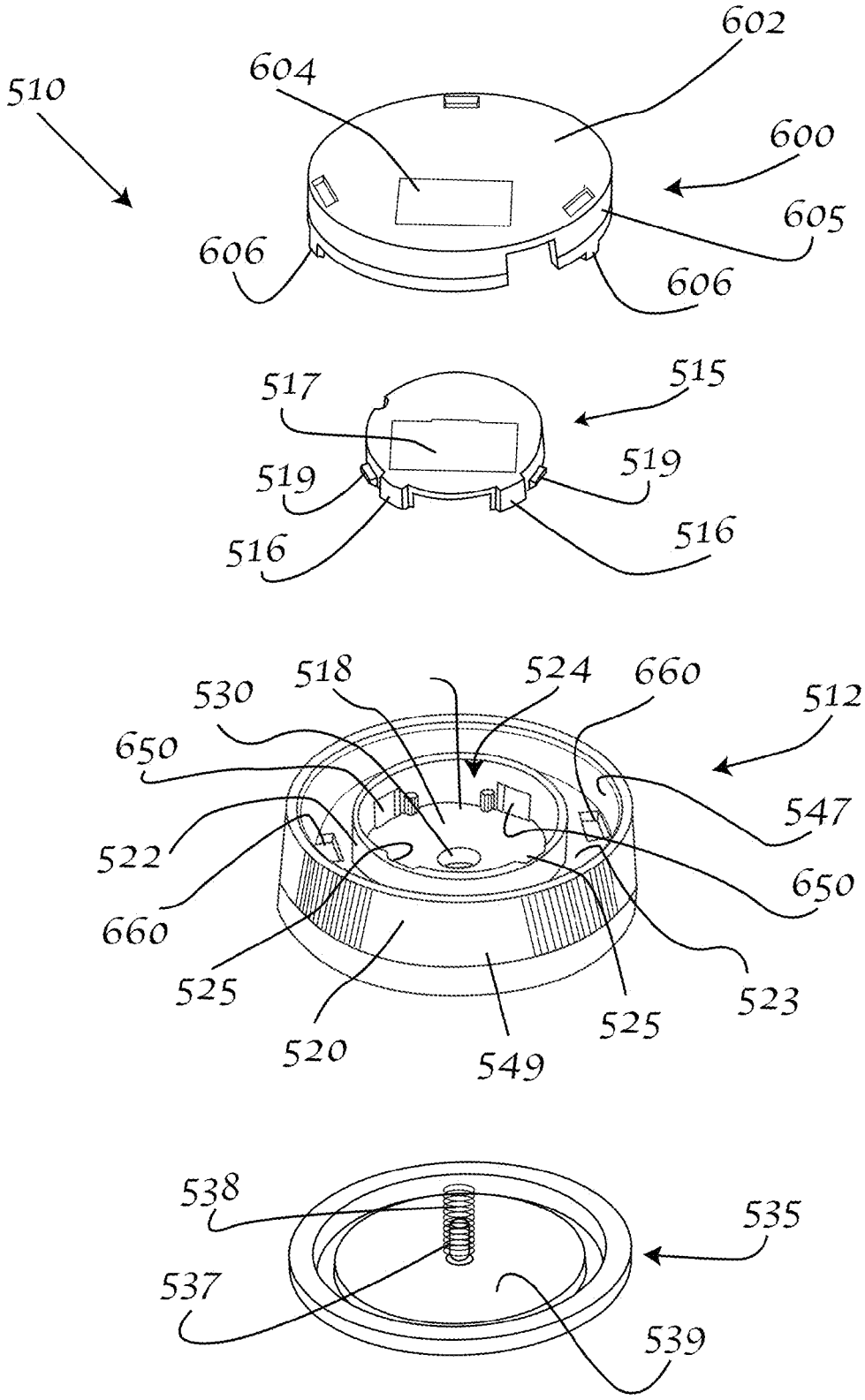
FIG. 6 is an illustration of an exploded view of another embodiment of a container cap with a timer showing a housing with a top cover.

FIG. 6 is an illustration of an exploded view of another embodiment of a container cap with a timer showing a top housing. As shown in FIG. 6, the container cap 510 preferably includes a first housing portion 512, second housing portion 600, timer 515, central post 537, central post spring 538, and sealing disk 535. First housing portion 512 is preferably comprised of outer cylindrical wall 520, inner surface 547, outer surface 549, timer slot 524, timer lower surface 518, central hole 530, timer side wall 522, housing notches 660, and timer notches 650. The timer preferably includes display 517 and timer locking tabs 519. The timer 515 also preferably includes alignment portions 516, which matingly engages with slot engagement portions 525 of first housing portion 512, which improves the manufacturing efficiency of the assembly process and thus helps reduce manufacturing costs. The sealing disk 535 is preferably comprised of upper surface 539. The second housing portion 600 is comprised of a substantially flat top surface 602, a display hole 604, an outer cylindrical wall portion 605, and housing locking tabs 606.

The timer locking tabs 519 and housing locking tabs 606 significantly improve the manufacturability of the container cap 10. Thus, the manufacturing costs are reduced by reducing the manufacturing assembly time and enabling replacement of faulty timer units in the container cap during the manufacturing functional test steps, thus reducing the overall manufacturing scrap rate. Furthermore, because the container caps 10 may be a disposable consumer product, the timer locking tabs 519 and housing locking tabs 606 also promote recycling and reclamation initiatives as the electronic components can be readily separated from the plastic components for appropriate recycling.

As shown in FIG. 5, the container cap 10 may also include an inwardly tapered spring catch 150 that circumscribes the central hole 30. The spring catch 150 ensures that the center post spring 38 is reliably guided into the central hole 30 both during the manufacturing assembly process and during the actual functional use of the container cap 10.

Figure 7:
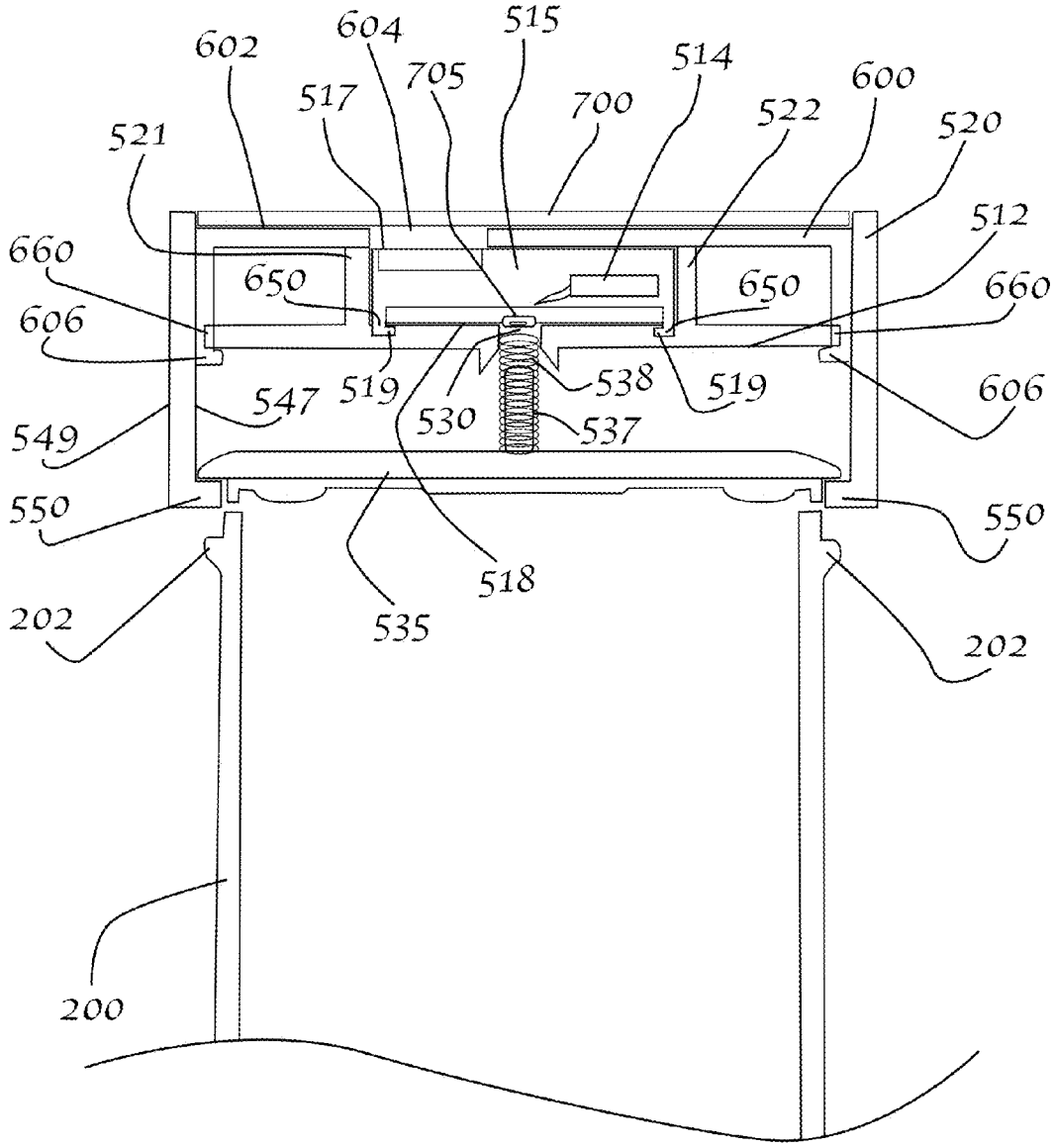
FIG. 7 is an illustration of a cross section view of another embodiment of a container cap with a timer showing a housing with a top cover.

FIG. 7 is an illustration of a cross section view of another embodiment of a container cap with a timer showing a top housing. As shown in FIG. 7, the container cap 510 preferably includes a first housing portion 512, second housing portion 600, timer 515, central post 537, central post spring 538, protective cover 700, and sealing disk 535. First housing portion 512 is preferably comprised of outer cylindrical wall 520, inner surface 547, outer surface 549, timer slot 524, timer slot lower surface 518, central hole 530, timer slot side wall 522, housing notches 660, and timer notches 650. The timer preferably includes display 517, timing electronics, battery 514, and timer locking tabs 519. The second housing portion 600 is comprised of a substantially flat top surface 602, a display hole 604, an outer cylindrical wall portion 605, and housing locking tabs 606. As shown in FIG. 7, the timer 515 is positioned within said timer slot 524. The timer locking tabs 519 of said timer matingly engage with the timer notches 650 of the timer slot 524, such that said timer 515 is held in place within the timer slot 524. FIG. 7 also shows that the second housing portion 600 matingly engages with said first housing portion 512, and the housing locking tabs 606 of said second housing portion 600 matingly engage with the housing notches 660 of the first housing portion such that said second housing portion 600 is held securely in place within said first housing portion 512 without glue or ultrasonic welding.

FIG. 7 also shows how the second housing portion 600 matingly engages with the first housing portion 512, such that the timer 515 is covered by the substantially flat top surface 602 of the second housing portion 600, wherein the display 517 of said timer 515 is substantially visible through the display hole 604 of said second housing portion 600, and wherein an outer surface of the outer cylindrical wall portion 605 of said second housing portion 600 is within the inner surface 547 of the outer cylindrical wall portion 520 of said first housing portion 512.

The protective cover 700, as shown in FIG. 7, preferably substantially covers a top surface 602 of the second housing portion 600. The protective cover 700 also may cover the display hole 604 of the second housing portion 600. However, in order to see the display 517 of timer 515, the protective cover is preferably transparent over the display hole 604 and display 517. Typically, the portion of the protective cover not over the display hole 604 and display 517, includes instructions, trademarks, or graphics.

Figure 8:
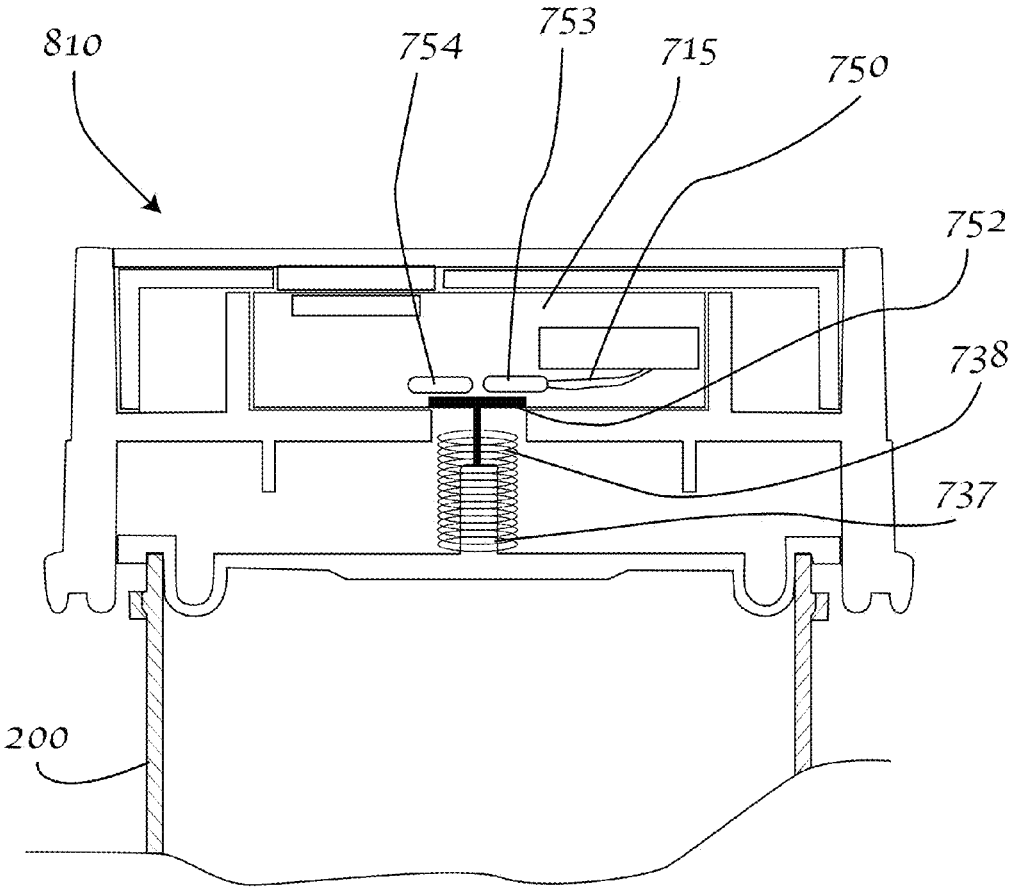
FIG. 8 is an illustration of a cross section view of one embodiment of a container cap with a timer showing a micro switch.

FIG. 8 is an illustration of a cross section view of one embodiment of a container cap with a timer showing a micro switch. As shown in FIG. 8, the center post 737 is engaged with center post spring 738 and includes a microswitch activation tip 752. Activation switch 750 of timer 715 may include two microswitch pads 753 and 754. The center post 737 and microswitch activation tip 752 are forced upward when container cap 810 is engaged with container 200, such that microswitch 752 contacts both of the microswitch pads 753 and 754. Once in contact, Micro switch activation tip 752 creates an electrically conductive bridge between micro switch pads 753 and 754 that activates the timer 715. The contact is held in place for the duration of the container cap 810 being secured to the container 200. When the container cap 810 is disengaged with the container 200, the micro switch 752 breaks contact with the micro switch pads 753 and 754, and the timer 715 stops.

Figure 9:
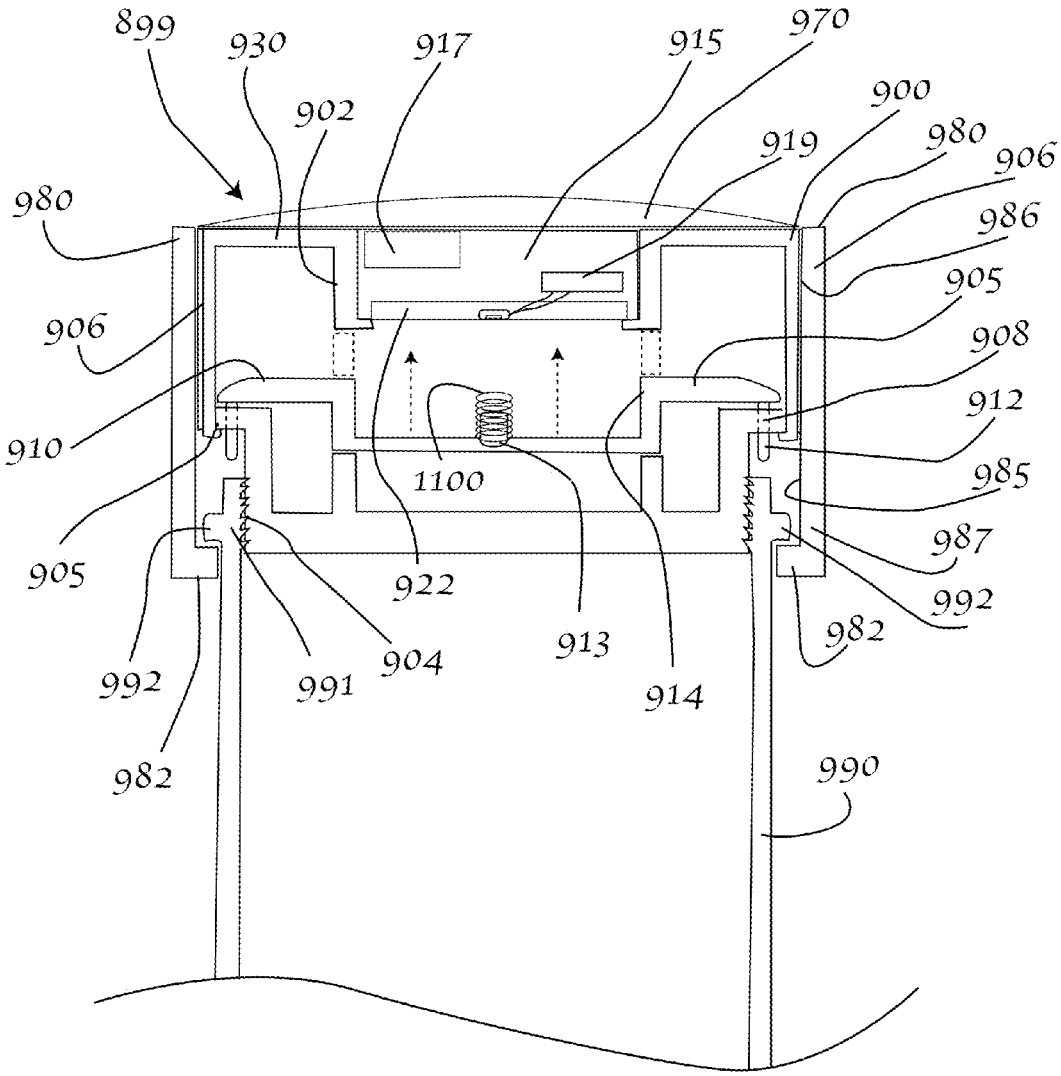
FIG. 9 is an illustration of a cross section view of one embodiment of a container cap with a timer showing a child-proof conversion ring.

FIG. 9 is an illustration of a cross section view of one embodiment of a container cap with a timer showing a child-proof conversion ring. As shown in FIG. 9, in another embodiment the container cap 899 may include a timer 915, an activation mechanism 910, and a housing portion 900. Preferably, the timer 915 has a display 917, battery 919, timing electronics, bottom side 922, and an activation switch 921. FIG. 9 shows that the housing portion 900 is comprised of a face piece 930 with an integrated timer slot 902, a lower cylindrical container engagement portion 904, a shoulder portion 905, and an upper cylindrical wall portion 906. FIG. 9 shows how the shoulder portion 905 is preferably disposed between the lower cylindrical container engagement portion 904 and said upper cylindrical wall portion 906. FIG. 9 also shows that shoulder portion 905 may have a container engagement pin hole 908. As shown in FIG. 9, the timer 915 is positioned within the timer slot 902, such that the display 917 is visible from the top side of container cap 899 and the activation switch 921 is accessible on a bottom side 922 of said timer 915.

Preferably, the timer slot 902 of the face piece 930 is preferably further comprised of a plurality of notches, wherein when the timer 915 is positioned within the timer slot 902, the plurality of locking tabs of the timer matingly engage with the plurality of notches of the timer slot such that the timer 915 is held in place within the timer slot.

Preferably, the face piece 930 with an integrated timer slot 902 has locking tabs, which allow it to matingly engage with the corresponding notches present in the combined structure of the lower cylindrical container engagement portion 904, the shoulder portion 905, and the upper cylindrical wall portion 906. Thus, the face piece 930 with an integrated timer slot 902 is held securely in place within the aforementioned combined structure (i.e., the lower cylindrical container engagement portion 904, the shoulder portion 905, and the upper cylindrical wall portion 906) without glue or ultrasonic welding.

Preferably, the activation mechanism 910 is substantially rigid and includes an activation switch engagement portion 913, activation arms 914, and container engagement pins 912. Although FIG. 9 shows two container engagement pins, any number may be used, and preferably, three or four pins are included. FIG. 9 also shows that the invention may include a coil spring 1100 that is connected to said activation switch engagement portion 913 such that a lower portion of said coil spring matingly surrounds said activation switch engagement portion 913 and an upper portion of said center post spring extends beyond activation switch engagement portion towards said activation switch 921.

The coil spring 1100 is connected to the activation switch engagement portion 913 such that a lower portion of coil spring 1100 matingly surrounds the activation switch engagement portion 913 and an upper portion of said coil spring 1100 extends beyond the distal length of the activation switch engagement portion 913. The coil spring 1100 helps to push the activation mechanism 910 away from the timer 915 and ensures that the activation switch engagement portion 913 ceases to activate the activation switch 921 of the timer 915 when the container cap 899 is disengaged with the container 990.

As shown in FIG. 9, the activation arms 914 connect the activation switch engagement portion 913 to the container engagement pins 912, such that when an upward force is applied to the container engagement pins 912, the activation switch engagement portion 913 is also pushed upward. FIG. 9 shows, that, preferably, the activation mechanism 910 is positioned within the housing portion 900 such the container engagement pins 912 are disposed slideably within the container engagement pin holes 908 of the shoulder portion 905. FIG. 9 also shows that the activation switch engagement portion 913 is adjacent to and aligned with activation switch 921 of the timer 915, such that when the container cap 899 is engaged with and secured to a container, a lip 991 of the container 990 engages with the container engagement pins 912, which causes the activation switch engagement portion 913 to engage with the activation switch 921 of the timer 915. This starts the timer 915. When the container cap 899 is disengaged the timer is stopped. FIG. 9 shows that the container cap 899 is preferably screwed onto container 990 using threaded container engagement portion 904 and thread 991.

As shown in FIG. 9, the container cap 899 may include a removable cylindrical childproof safety ring 980. Preferably, the removable cylindrical childproof safety ring has an interior surface 985 and an exterior surface 984. The interior surface 985 of the removable cylindrical childproof safety ring 980 preferably includes an upper portion 986 and a lower portion 987. The lower portion 987 of the interior surface 985 preferably has childproof engagement portions 982. Preferably, the upper portion 986 of said interior surface 985 removeably, and matingly, engages with an exterior surface of the upper cylindrical wall portion 906. Typically, housing portion 900 slides into safety ring 980 and rest snuggly within safety ring 980. The childproof engagement portions 982 engage with an exterior surface and childproof cap engagement portions 992 of container 990 when the container cap 899 is secured to the container 990.

FIG. 9 shows that the container cap 899 may also include a protective cover 970. The protective cover 970 preferably substantially covers the timer 915. In order to view the display 917, the protective cover is preferably transparent over the display 917.

The removable child-proof safety ring 980 allows the closure cap to be used with any type of container that uses a child-proof or child-resistant opening. The removable child-proof safety ring 980 illustratively includes an upper portion 986 engaging adjacent outer surface portions of the upper housing portion 900 and a lower portion 987 connected to the upper portion 986 and being in radially spaced apart relation from adjacent surface portions of the lower portions of the housing 900. Therefore, the housing 900 can be readily inserted into the removable child-proof safety ring 980 so that the closure cap can be secured to a child-proof pill container as well as to a pill container having a threaded opening. This enables the closure cap on the same pill container to perform in either "child-proof" mode or be converted, by removal of child-proof safety ring, into "easy off" mode using the internal threads of the container opening.

The protective covers shown in the drawings is preferably made from scratch resistant or self-healing polymer or gel and helps protect the timer and any graphics on the container cap or within the protective cover. The self-healing polymer may include, but is not limited to: epoxy resins, polymer gels, polyurethanes, latex, silicone, and butyl rubber, and/or polycarbonate sheets, which might include a hard-coat outer layer that uses a cold-flow mechanism to heal scratches to the hard-coat. The self-healing polymer usually has one or more layers.

Figure 10:
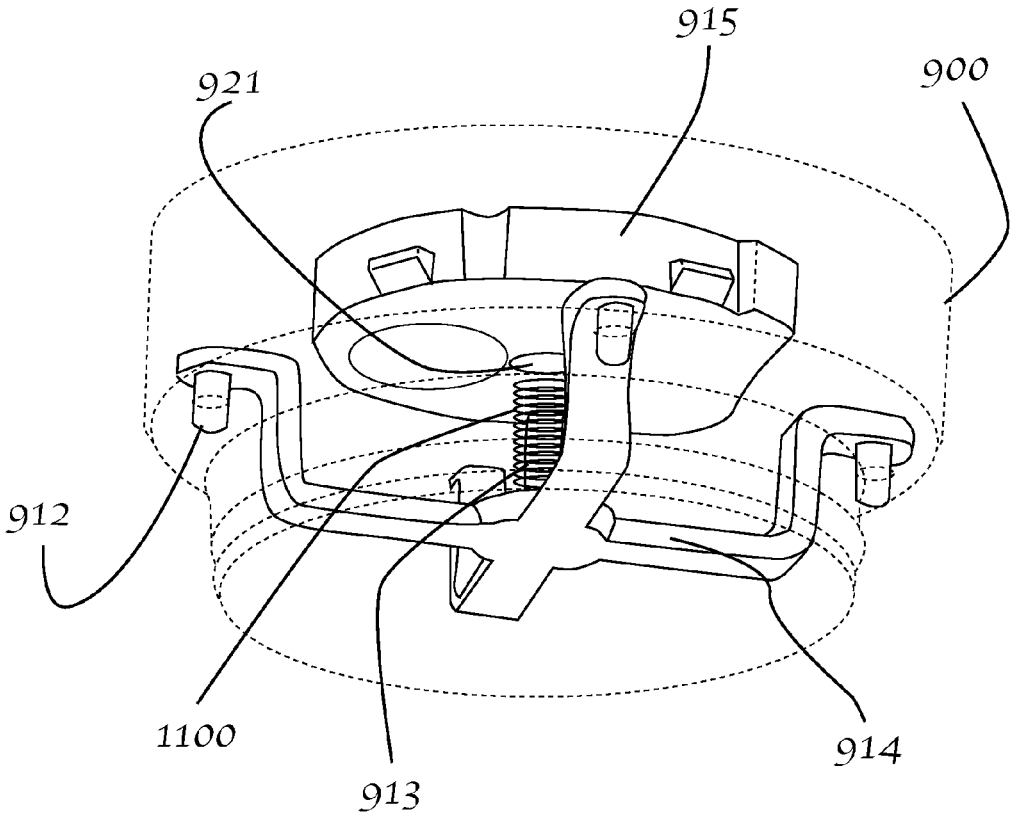
FIG. 10 is an illustration of a perspective view of one embodiment of a container cap with a timer.

FIG. 10 is an illustration of a perspective view of one embodiment of a container cap with a timer. As shown in FIG. 10, the housing portion 900 preferably has an array of container engagement pins 912 around an outer circumference of housing portion 900. In this manner, when housing portion 900 is attached to a container, the lip of the container pushes up on container engagement pins 912, which pushes activation switch engagement portion 913 up into the activation switch 921 of timer 915. Although four engagement pins 912 are shown in FIG. 10, any number of engagement pins 912 may be used. FIG. 10 also shows that the invention may include a coil spring 1100 that is connected to said activation switch engagement portion 913 such that a lower portion of the coil spring 1100 matingly surrounds said activation switch engagement portion 913 and an upper portion of the coil spring 1100 extends beyond activation switch engagement portion towards said activation switch 921.

The said coil spring 1100 is preferably connected to the activation switch engagement portion 913 such that a lower portion of said coil spring 1100 matingly surrounds the activation switch engagement portion 913 and an upper portion of coil spring 1100 extends beyond the distal length of the activation switch engagement portion 913. The coil spring 1100 helps to push the activation mechanism 910 away from the timer 915 and ensures that the activation switch engagement portion 913 ceases to activate the activation switch 921 of the timer 915 when the container cap 899 is disengaged with the container 990.

Figure 11:
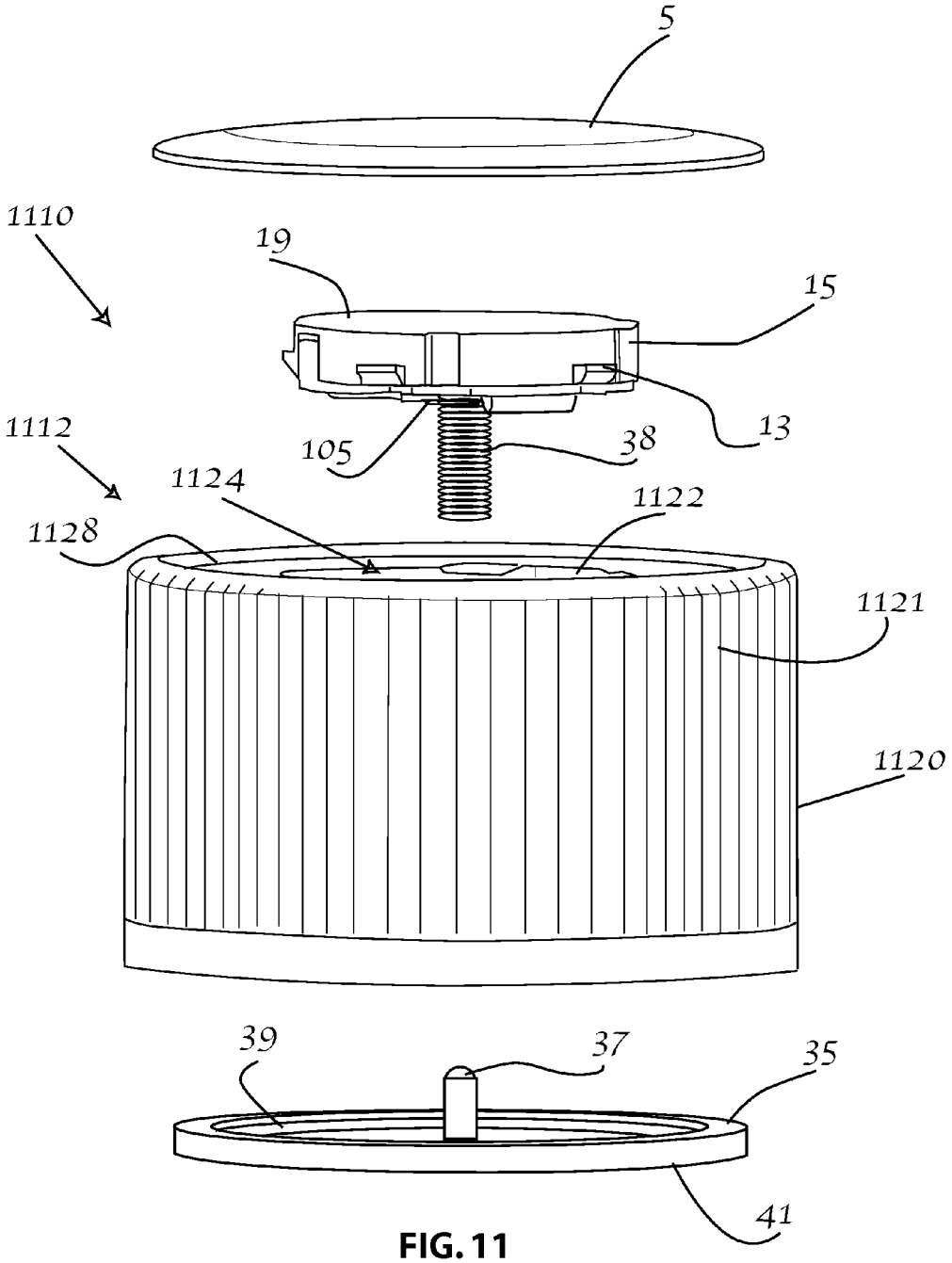
FIG. 11 is an illustration of a side exploded view of one embodiment of a container cap with a timer with a topless housing.

FIG. 11 is an illustration of a side exploded view of one embodiment of a container cap with a timer with a topless housing. As shown in FIG. 11, the container cap 1110 is preferably comprised of a protective cover 5, timer 15, a sealing disk 35, a center post 37, center post spring 38, and a housing portion 1112. The timer 15 preferably includes display 17 (shown in FIG. 14), which is typically a liquid crystal display, and activation switch 105. The timer 15, which is also referred to as a timer module, may also include a housing, typically made out of plastic, an integrated circuit board, battery, and microswitch. The timer 15 preferably includes timer alignment features, which improve the manufacturing efficiency of the assembly process and thus helps reduce manufacturing costs. The timer may also include a snap fit leg 13 that fits with a notch in first housing portion 1112 to securely, but removeably hold timer 15 within housing portion 1112. As shown in FIG. 11, the housing portion 1112 preferably includes an outer cylindrical wall portion 1120, grip ridges 1121, which allows the device to be gripped and turned more easily, timer slot 1124, and slot alignment features 1125. Preferably, the timer slot 1124 has a lower surface 1118 (shown in FIG. 15) and timer side wall 1122. As shown in FIG. 11, sealing disk 35 is preferably substantially circular and is preferably comprised of an upper surface 39 and a lower surface 41. FIG. 11 also shows that the center post 37 is may be part of or attached to attached to the upper surface 39 of the sealing disk 35 and extends substantially perpendicularly away from the upper surface 39. FIG. 11 also shows how timer 15 is preferably adapted to fit into timer slot 24 and that sealing disk 35 is adapted to fit within housing portion 1112 such that center post 37 lines up with central hole 1130

Figure 13:
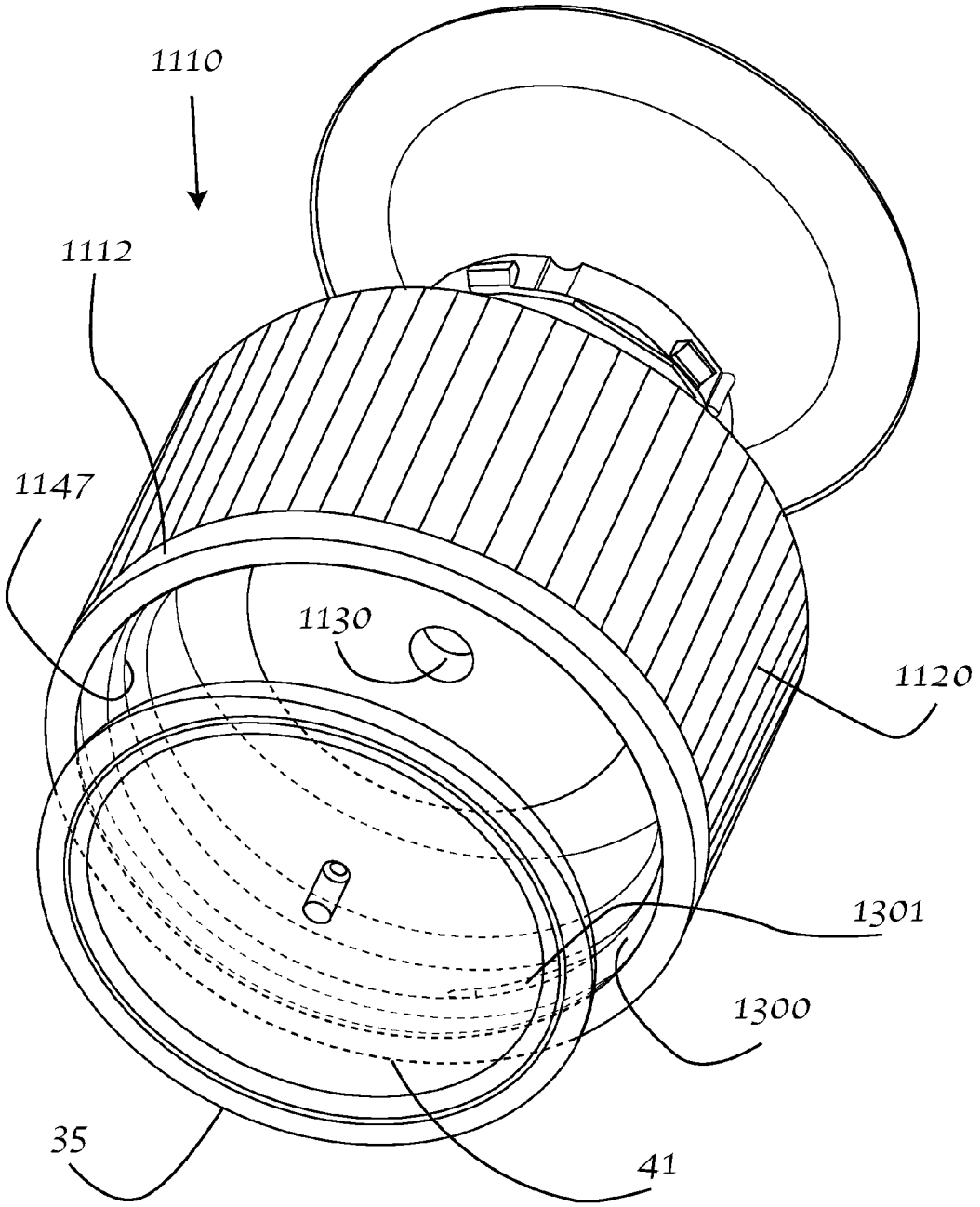
FIG. 13 is an illustration of a bottom exploded view of one embodiment of a container cap with a timer.
Figure 14:
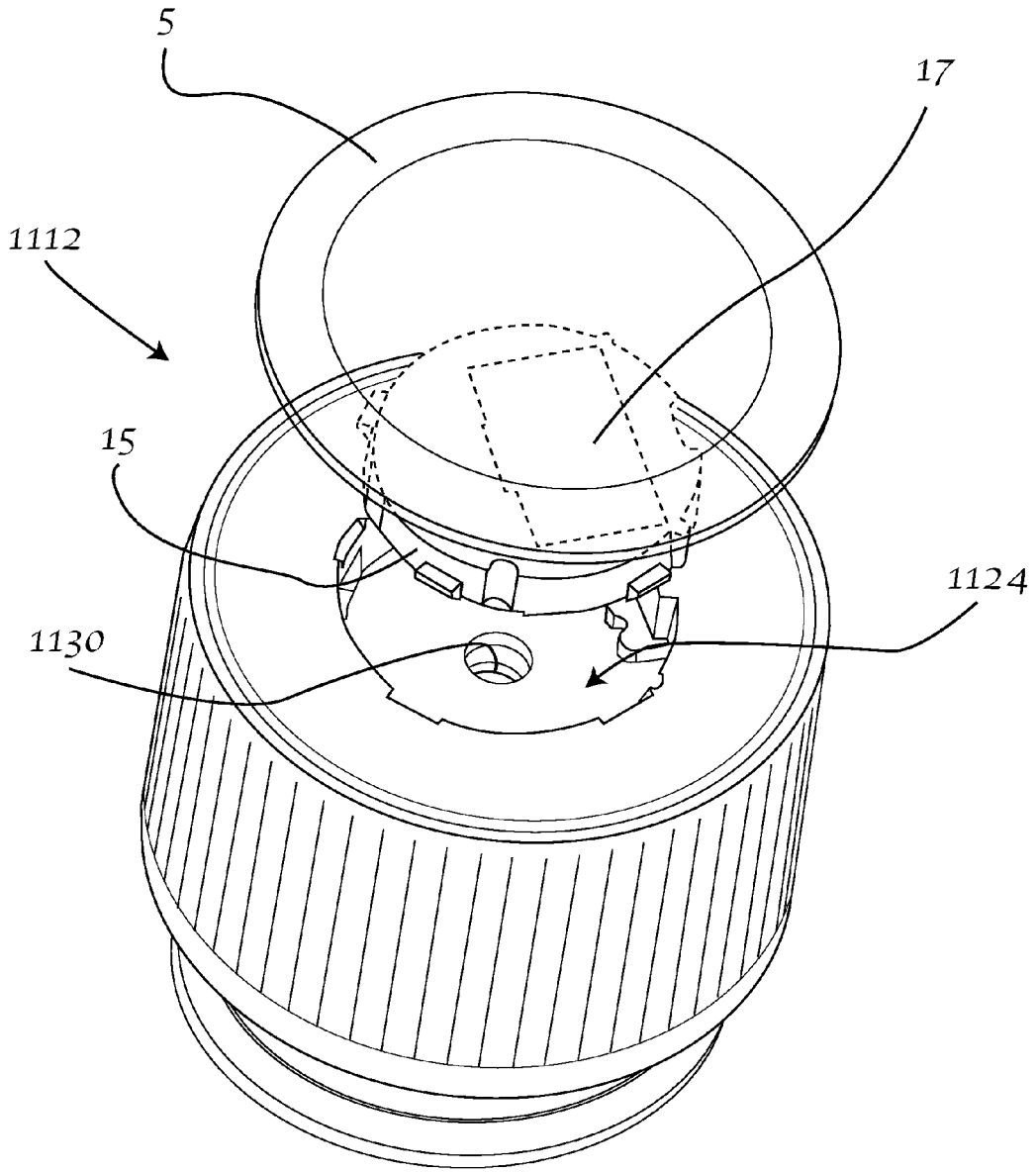
FIG. 14 is an illustration of a top perspective exploded view of one embodiment of a container cap with a timer.
Figure 15:
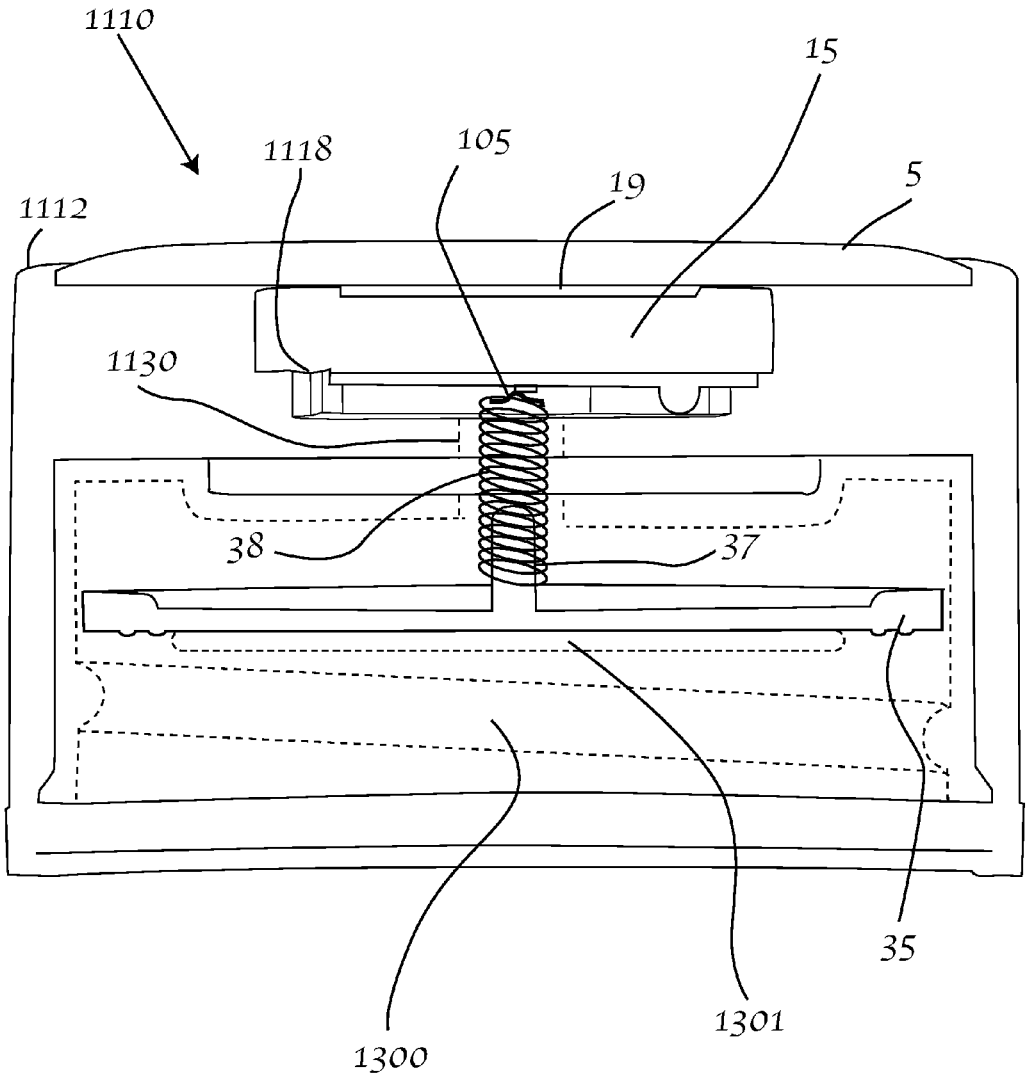
FIG. 15 is an illustration of a cross-section view of one embodiment of a container cap with a timer.

(shown in FIGS. 13-15). FIG. 11 also shows how housing portion 1112 preferably has a lip or recess 1128 into which the protective cover 5 fits.

Figure 12:
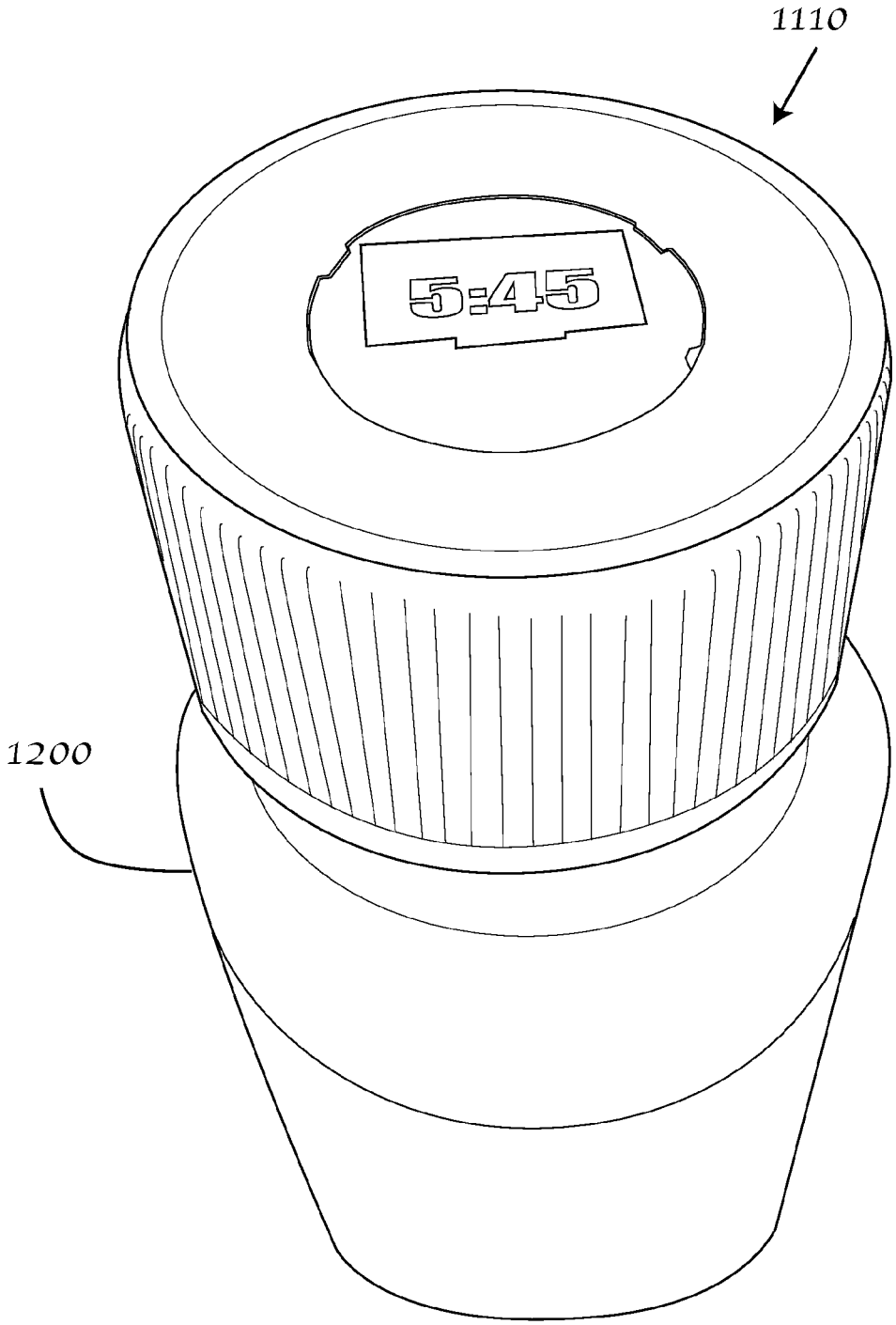
FIG. 12 is an illustration of a perspective view of one embodiment of a container cap secured to a container.

FIG. 12 is an illustration of a perspective view of one embodiment of a container cap secured to a container. FIG. 12 show that the container cap 1110 preferably engages with a container or bottle with common screw-on threading 1200. Preferably the container cap 1110 is either a childproof or non-childproof container cap and the timer is used to determine when the container cap was secured to the container.

FIG. 13 is an illustration of a bottom exploded view of one embodiment of a container cap with a timer. As shown in FIG. 13, the timer slot 1124 of housing portion 1112 preferably has a substantially central hole 1130. FIG. 13 also shows the lower surface 41 of sealing disk 35. Sealing disk 35 is preferably adapted to create a seal between the container cap 1100 and a container, when the container cap 1100 is secured to, or otherwise engaged with, the container.

FIG. 13 shows that the outer cylindrical wall portion 1120 has an inner surface 1147. Preferably, the inner surface 1147 of the outer cylindrical wall portion 1120 has internal screw thread 1300 to matingly engage and disengage with common external screw thread of a container. Preferably, the inner surface 1147 of the outer cylindrical wall portion 1120 has one or more sealing disk engagement ridges 1301. The sealing disk engagement ridges 1301 are configured to keep the sealing disk 35 substantially in place within the inner surface 1147. Timer 15 has an activation switch 105 that is aligned with central hole 1130, such that when timer 15 is inserted into timer slot 1124, the activation switch 105 is accessible through central hole 1130.

FIG. 14 is an illustration of a top perspective exploded view of one embodiment of a container cap with a timer. As shown in FIG. 14, the timer 15 fits flush within timer slot 1124. This allows the container cap to easily accept a protective cover 5 or graphics on a top of the container cap 1112. FIG. 14 also shows how display 17 is visible on a top of timer 15.

FIG. 15 is an illustration of a cross-section view of one embodiment of a container cap with a timer. As shown in FIG. 15, container cap 1110 is preferably comprised of housing portion 1112, timer 15, central post 37, central post spring 38, and sealing disk 35. Housing portion 1112 is preferably comprised of timer slot 1124, hole 1130, internal screw thread 1300, which engages with a common external screw thread of bottles or containers, and sealing disk engagement ridges 1301. The timer 15 preferably includes a display, battery, activation switch 105, and top surface 19. As shown in FIG. 15, the center post 37 is positioned to be able to pass through the substantially central hole 1130 of the lower surface 1118 of the timer slot 1124. FIG. 15 shows that the sealing disk 35 and said center post 37 are pushed towards the timer 15 when the container cap 1112 is engaged with, or secured to, a container 200. In this manner, the center post 37 activates the activation switch 105 of the timer 15 and starts the timer 15. Preferably, the center post 37 ceases to activate the activation switch 105 of the timer 15 when the container cap 1110 is disengaged with the container 1200.

FIG. 15 also shows said center post spring 38 is connected to the center post 37 such that a lower portion of said center post spring 38 matingly surrounds the center post 37 and an upper portion of said center post spring 38 extends beyond the distal length of the center post 37. The center post spring 38 helps to push the sealing disk 35 away from the timer 15 and ensures that said center post 37 ceases to activate the activation switch 105 of the timer 15 when the container cap 12 is disengaged with the container 200. The container cap 1110, as shown in FIG. 15 is further comprised of a protective cover 5. The protective cover 5 substantially covers a top surface 19 of the timer 15, the display 17 of the timer 15, and the substantially flat top surface of the housing portion 1112. The protective cover 5 is preferably transparent over at least the display 17 of the timer 15, such that the display 17 is visible through the protective cover 5. Preferably, the container cap is a childproof container cap and the timer is used to determine when the container cap 1110 was secured to the container.

Figure 16:
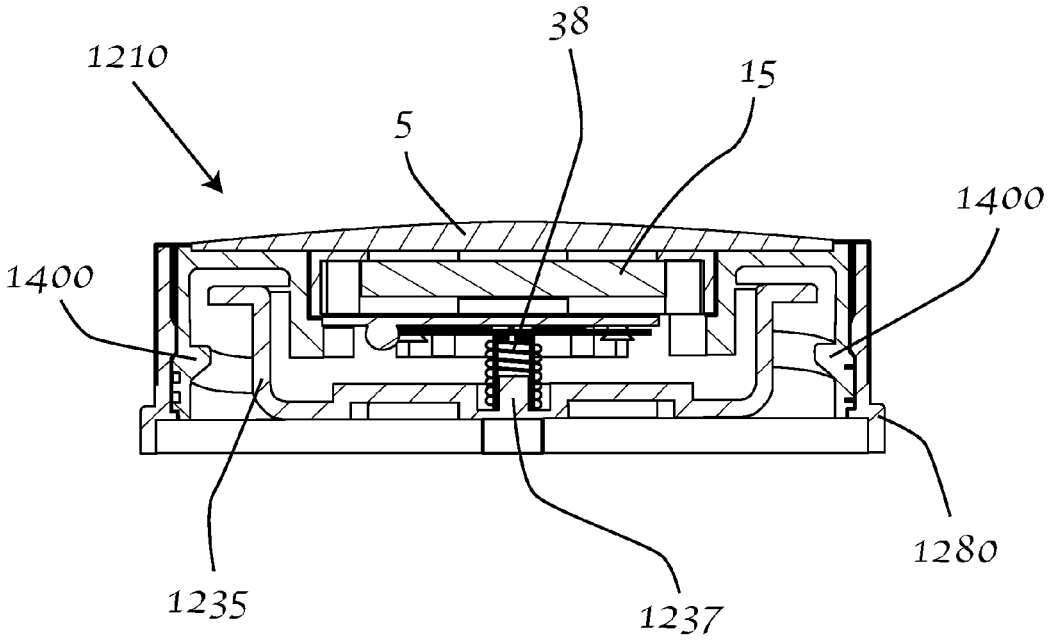
FIG. 16 is an illustration of a cross-section view of another embodiment of a container cap with a timer with a cup-shaped sealing disk.

FIG. 16 is an illustration of a cross-section view of another embodiment of a container cap with a timer with a cup-shaped sealing disk. As shown in FIG. 16, container cap 1210 is preferably comprised of timer 15, central post 1237, central post spring 38, cup-shaped sealing disk 1235, and internal screw thread 1400. Internal screw or lug thread 1400 engages with a common external screw thread of a bottle or container. When cap 1210 is screwed onto a bottle, the top lip of the bottle pushes up on edges of cup-shaped sealing disk 1235 such that central post 1237 and central post spring 38 are pushed towards the timer 15. In this manner, the center post 1237 activates the activation switch of the timer 15 and preferably automatically starts the timer 15. Preferably, the center post 1237 automatically ceases to activate the activation switch of the timer 15 when the container cap 1210 is disengaged with from container. Internal screw or lug threads 1400 preferably keep the center post 1237 in place when the cap is removed. FIG. 16 also shows the center post spring 38 is connected to the center post 1237 such that a lower portion of the center post spring 38 matingly surrounds the center post 1237 and an upper portion of the center post spring 38 extends beyond the distal length of the center post 1237. The center post 1237 is shown as a pin or post, but may be any type of activation mechanism. The center post spring 38 helps to push the sealing disk 1235 away from the timer 15 and ensures that the center post 1237 ceases to activate the activation switch of the timer 15 when the container cap 1210 is disengaged with the container. FIG. 16 shows that cap 1210 is preferably further comprised of a protective cover 5. The protective cover 5 substantially covers a top surface of the timer 15, the display of the timer 15. The protective cover 5 is preferably transparent over at least the display of the timer 15, such that the display is visible through the protective cover 5. Preferably, the container cap is either an easy off or a childproof container cap and the timer is used to determine when the container cap 1210 was last secured to the container. FIG. 16 also shows that cap 1210 may also include removable cylindrical childproof safety ring 1280. Ring 1280 may be an over cap or other similar childproof safety device.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

What is claimed is:

1. A container cap with a timer, comprising:

a container cap;

wherein said container cap comprises: a timer, a sealing disk, a center post, and a first housing portion;

wherein said sealing disk is substantially circular and is comprised of an upper surface and a lower surface;

wherein said center post is attached to said upper surface of said sealing disk and extends substantially perpendicularly away from said upper surface;

wherein said timer is comprised of a display and an activation switch;

wherein said first housing portion is comprised of a timer slot and an outer cylindrical wall portion;

wherein said outer cylindrical wall portion has and an outer surface and an inner surface;

wherein said inner surface of said outer cylindrical wall portion has one or more container engagement portions;

wherein said timer slot of said first housing portion has a lower surface and one or more timer side walls, wherein said lower surface of said timer slot has a hole;

wherein said timer is positioned within said timer slot such that said display is visible on a top side of said first housing portion, and said activation switch is accessible through said hole of said lower surface of said timer slot;

wherein said sealing disk is positioned within said inner surface of said outer cylindrical wall portion between said lower surface of said timer slot and said one or more container engagement portions, such that said center post is positioned to be able to pass through said hole of said lower surface of said timer slot, and said sealing disk is kept substantially in place within said inner surface of said outer cylindrical wall portion.

2. The container cap with a timer of claim 1, wherein said sealing disk and said center post are pushed towards said timer when said container cap is engaged with a container, such that said center post activates said activation switch of said timer and starts said timer; and wherein said center post ceases to activate said activation switch of said timer when said container cap is disengaged with said container.

3. The container cap with a timer of claim 2, wherein said one or more container engagement portions is an internal screw thread; and wherein said internal screw thread is configured to matingly engage and disengage with an external screw thread of said container.

4. The container cap with a timer of claim 3, wherein said first housing portion further comprises one or more sealing disk engagement ridges; and wherein said one or more sealing disk engagement ridges are configured to keep said sealing disk substantially in place within said inner surface of said outer cylindrical wall portion.

5. The container cap with a timer of claim 2, wherein said container cap further comprises:

a center post spring;

wherein said center post spring is connected to said center post such that a lower portion of said center post spring matingly surrounds said center post and an upper portion of said center post spring extends beyond said center post;

wherein said center post spring ensures that said center post ceases to activate said activation switch of said timer when said container cap is disengaged with said container.

6. The container cap with a timer of claim 5, wherein said first housing portion is further comprised of a substantially flat top surface;

wherein said top surface extends between said one or more timer side walls of said timer slot and said outer cylindrical wall portion; and wherein said substantially flat top surface of said first housing portion is substantially flush with a substantially flat top surface of said timer.

7. The container cap with a timer of claim 6, wherein said timer is further comprised of a plurality of locking tabs; and wherein said timer slot of said first housing portion is further comprised of a plurality of notches;

wherein when said timer is positioned within said timer slot, said plurality of locking tabs matingly engage with said plurality of notches such that said timer is held in place within said timer slot.

8. The container cap with a timer of claim 6, wherein said first housing portion further comprising one or more sealing disk engagement portions and one or more rib structures.

9. The container cap with a timer of claim 6, wherein said container cap is further comprised of a protective cover;

wherein said protective cover substantially covers a top surface of said timer, said display of said timer, and said substantially flat top surface of said first housing portion; and wherein said protective cover is transparent over said display of said timer, such that said display is visible through said protective cover.

10. The container cap with a timer of claim 5, wherein said container cap is further comprised of a second housing portion;

wherein said second housing portion is comprised of a top surface, a display hole, and an outer cylindrical wall portion;

wherein said second housing portion matingly engages with said first housing portion such that said timer is covered by said substantially flat top surface of said second housing portion, wherein said display of said timer is substantially visible through said display hole of said second housing portion, and wherein an outer surface of said outer cylindrical wall portion of said second housing portion is within said inner surface of said outer cylindrical wall portion of said first housing portion.

11. The container cap with a timer of claim 10, wherein said timer is further comprised of a plurality of timer locking tabs; and wherein said timer slot of said first housing portion is further comprised of a plurality of timer notches;

wherein when said timer is positioned within said timer slot, said plurality of timer locking tabs of said timer matingly engage with said plurality of timer notches of said timer slot such that said timer is held in place within said timer slot.

12. The container cap with a timer of claim 11, wherein said second housing portion is further comprised of a plurality of housing locking tabs; and wherein said first housing portion is further comprised of a plurality of housing notches;

wherein when said second housing portion matingly engages with said first housing portion, said plurality of housing locking tabs of said second housing portion matingly engage with said plurality of housing notches of said first housing portion such that said second housing portion is held in place within said first housing portion.

13. The container cap with a timer of claim 12, wherein said center post has a microswitch activation tip;

wherein said activation switch is comprised of two microswitch pads;

wherein said microswitch activation tip creates an electrically conductive bridge that activates said timer when said container cap is secured to said container.

14. The container cap with a timer of claim 10, wherein said container cap is further comprised of a protective cover;

wherein said protective cover and substantially covers a top surface of said second housing portion and said display hole of said second housing portion;

wherein said protective cover is transparent over said display hole of said second housing portion, such that said display is visible through said protective cover.

15. The container cap with a timer of claim 14, wherein said container cap is a childproof container cap.

16. The container cap with a timer of claim 15, wherein said timer is used to determine when said container cap was secured to said container.

17. A container cap with a timer, comprising:

a container cap, wherein said container cap comprises: a timer, a sealing disk, a center post, a first housing portion; a second housing portion; and a center post spring;

wherein said sealing disk is substantially circular and is comprised of an upper surface and a lower surface;

wherein said center post is attached to said upper surface of said sealing disk and extends substantially perpendicularly away from said upper surface;

wherein said timer is comprised of a display and an activation switch;

wherein said first housing portion is comprised of a timer slot, one or more container engagement portions, one or more sealing disk engagement portions, one or more rib structures, and an outer cylindrical wall portion;

wherein said outer cylindrical wall portion has and an outer surface and an inner surface;

wherein said inner surface of said outer cylindrical wall portion has one or more container engagement portions;

wherein said timer slot of said first housing portion has a lower surface and one or more timer side walls, wherein said lower surface of said timer slot has a substantially central hole;

wherein said timer is positioned within said timer slot such that said display is visible on a top side of said first housing portion, and said activation switch is accessible through said substantially central hole of said lower surface of said timer slot;

wherein said sealing disk is positioned within said inner surface of said outer cylindrical wall portion between said lower surface of said timer slot and said one or more container engagement portions, such that said center post is positioned to be able to pass through said substantially central hole of said lower surface of said timer slot, and said sealing disk is kept substantially in place within said inner surface of said outer cylindrical wall portion;

wherein said sealing disk and said center post are pushed towards said timer when said container cap is engaged with a container, such that said center post activates said activation switch of said timer and starts said timer;

wherein said center post ceases to activate said activation switch of said timer when said container cap is disengaged with said container;

wherein said center post spring is connected to said center post such that a lower portion of said center post spring matingly surrounds said center post and an upper portion of said center post spring extends beyond said center post;

wherein said center post spring ensures that said center post ceases to activate said activation switch of said timer when said container cap is disengaged with said container wherein said second housing portion is comprised of a substantially flat top surface, a display hole, and an outer cylindrical wall portion;

wherein said second housing portion matingly engages with said first housing portion such that said timer is covered by said substantially flat top surface of said second housing portion, wherein said display of said timer is substantially visible through said display hole of said second housing portion, and wherein an outer surface of said outer cylindrical wall portion of said second housing portion is within said inner surface of said outer cylindrical wall portion of said first housing portion;

wherein said timer is further comprised of a plurality of timer locking tabs;

wherein said timer slot of said first housing portion is further comprised of a plurality of timer notches;

wherein when said timer is positioned within said timer slot, said plurality of timer locking tabs of said timer matingly engage with said plurality of timer notches of said timer slot such that said timer is held in place within said timer slot;

wherein said second housing portion is further comprised of a plurality of housing locking tabs;

wherein said first housing portion is further comprised of a plurality of housing notches;

wherein when said second housing portion matingly engages with said first housing portion, said plurality of housing locking tabs of said second housing portion matingly engage with said plurality of housing notches of said first housing portion such that said second housing portion is held in place within said first housing portion;

wherein said protective cover substantially covers a top surface of said second housing portion and said display hole of said second housing portion timer;

wherein said protective cover is transparent over said display hole of said second housing portion timer, such that said display is visible through said protective cover;

wherein said container cap is a childproof safety cap.

18. A container cap with a timer, comprising:

a container cap;

wherein said container cap comprises: a timer, an activation mechanism, and a housing portion;

wherein said housing portion is comprised of a timer slot, a lower cylindrical container engagement portion, a shoulder portion, and an upper cylindrical wall portion;

wherein said shoulder portion is disposed between said lower cylindrical container engagement portion and said upper cylindrical wall portion, and wherein said shoulder portion is comprised of one or more container engagement pin holes;

wherein said timer is comprised of a display and an activation switch;

wherein said timer is positioned within said timer slot such that said display is visible on a top side of said container cap, and said activation switch is accessible on a bottom side of said timer;

wherein said activation mechanism is substantially rigid and comprised of an activation switch engagement portion, one or more activation arms, and one or more container engagement pins;

wherein said one or more activation arms connect said activation switch engagement portion to said one or more container engagement pins;

wherein said activation mechanism is positioned within said housing portion such said one or more container engagement pins of said activation mechanism are disposed slideably within said one or more container engagement pin holes of said shoulder portion, and wherein said activation switch engagement portion of said activation mechanism is adjacent to said activation switch of said timer, such that when said container cap is engaged with a container, a lip of said container engages with said one or more container engagement pins of said activation mechanism, which causes said activation switch engagement portion of said activation mechanism to engage with said activation switch of said timer and starts said timer.

19. The container cap with a timer of claim 18, further comprising:

a removable cylindrical childproof safety ring;

wherein said removable cylindrical childproof safety ring has an interior surface and an exterior surface;

wherein said interior surface of said removable cylindrical childproof safety ring has an upper portion and a lower portion and wherein said lower portion of said interior surface has one or more childproof engagement portions;

wherein said upper portion of said interior surface of said removable cylindrical childproof safety ring removeably and matingly engages with an exterior surface of said upper removable cylindrical wall portion;

wherein said one or more childproof engagement portions of said removable cylindrical childproof safety ring engages with an exterior surface of said container when said container cap is secured to said container.

20. The container cap with a timer of claim 18, wherein said activation switch engagement portion has a microswitch activation tip;

wherein said activation switch is comprised of two microswitch pads;

wherein said microswitch activation tip creates an electrically conductive bridge that activates said timer when said container cap is secured to said container.

21. The container cap with a timer of claim 18, wherein said container cap further comprising a protective cover;

wherein said protective cover and substantially covers a top surface of said housing portion; and wherein said protective cover is transparent over said display of said timer, such that said display of said timer is visible through said protective cover.

22. The container cap with a timer of claim 18, wherein said container cap further comprising a spring; wherein said spring pushes said activation mechanism away from said timer and causes said activation switch engagement portion to cease activating said activation switch when said container cap is disengaged from said container.

23. A container cap with a timer, comprising:

a container cap;

wherein said container cap comprises: a timer, a sealing disk, and an activation mechanism;

wherein said sealing disk is substantially circular and is comprised of an upper surface and a lower surface;

wherein said activation mechanism is attached to said upper surface of said sealing disk and extends substantially perpendicularly away from said upper surface of said sealing disk;

wherein said timer is comprised of a display and an activation switch;

wherein said timer is positioned within said container cap such that said display is visible on a top side of said container cap;

wherein said activation switch is on a bottom side of said timer;

wherein said sealing disk is positioned within said container cap such that said activation mechanism engages with said activation switch when said container cap is engaged with a container and starts said timer.

24. The container cap with a timer of claim 23, wherein said activation mechanism ceases to activate said activation switch of said timer when said container cap is disengaged with said container.

25. The container cap with a timer of claim 24, wherein said sealing disk is cup-shaped.

26. The container cap with a timer of claim 25, wherein said activation mechanism is a center post.

27. The container cap with a timer of claim 26, wherein said one or more container engagement portions is an internal screw thread; and wherein said internal screw thread is configured to matingly engage and disengage with an external screw thread of said container.

28. The container cap with a timer of claim 27, wherein said internal screw thread substantially keeps said sealing disk in place within said container cap.

29. The container cap with a timer of claim 28, wherein said container cap further comprises:

a center post spring;

wherein said center post spring is connected to said center post such that a lower portion of said center post spring matingly surrounds said center post and an upper portion of said center post spring extends beyond said center post;

wherein said center post spring ensures that said center post ceases to activate said activation switch of said timer when said container cap is disengaged with said container.

30. The container cap with a timer of claim 28, wherein said container cap is a childproof safety cap.

* * * * *